US009377705B2

(12) United States Patent
Shimano et al.

(10) Patent No.: US 9,377,705 B2
(45) Date of Patent: Jun. 28, 2016

(54) TONER

(71) Applicant: CANON KABUSHIKI KAISHA, Tokyo (JP)

(72) Inventors: Tsutomu Shimano, Mishima (JP); Masatake Tanaka, Yokohama (JP); Naoya Isono, Suntou-gun (JP); Shintaro Noji, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/555,536

(22) Filed: Nov. 26, 2014

(65) Prior Publication Data

US 2015/0153670 A1 Jun. 4, 2015

(30) Foreign Application Priority Data

Nov. 29, 2013 (JP) ..... 2013-247687

(51) Int. Cl.
*G03G 9/087* (2006.01)

(52) U.S. Cl.
CPC ..... *G03G 9/08711* (2013.01); *G03G 9/08755* (2013.01); *G03G 9/08786* (2013.01); *G03G 9/08788* (2013.01); *G03G 9/08795* (2013.01); *G03G 9/08797* (2013.01)

(58) Field of Classification Search
CPC ..... G03G 9/08755; G03G 9/08788; G03G 9/08711; G03G 9/08786
USPC ..... 430/109.4, 109.3
See application file for complete search history.

(56) References Cited

U.S. PATENT DOCUMENTS 4,931,375 A * 6/1990 Akimoto ..... G03G 9/08788 430/109.3
4,940,644 A * 7/1990 Matsubara ..... G03G 9/08788 430/109.4

(Continued)

FOREIGN PATENT DOCUMENTS

JP 62-273574 A 11/1987
JP 63-27855 A 2/1988

(Continued)

OTHER PUBLICATIONS

Akiyama, et al., "Polymer Blend Compatibility and Interface", 1981, 1st Ed. pp. 16-19; pp. 120-123; and p. 314 (with partial translation).

(Continued)

*Primary Examiner* — Christopher D Rodee
(74) *Attorney, Agent, or Firm* — Fitzpatrick, Cella, Harper and Scinto

(57) ABSTRACT

A toner containing a toner particle containing a binder resin, wherein the binder resin contains a styrene-acrylic resin and a crystalline resin, and the crystalline resin is a block polymer or a graft polymer in which the mass ratio between the crystalline segment and an amorphous segment is 30:70 to 90:10, and wherein, in the total heat flow measured for the binder resin by a temperature-modulated differential scanning calorimeter, the peak temperature of an endothermic peak is from 55.0° C. to 90.0° C., and the percentage of the endothermic quantity of the endothermic peak in the reversing heat flow with respect to the endothermic quantity of the endothermic peak in the total heat flow is from 0.0% to 35.0%.

12 Claims, 4 Drawing Sheets

(56) References Cited

U.S. PATENT DOCUMENTS

| | | | | |
|---|---|---|---|---|
| 5,462,829 | A * | 10/1995 | Tyagi | G03G 9/08755 430/109.3 |
| 7,842,446 | B2 | 11/2010 | Yanase et al. | |
| 2011/0294061 | A1 * | 12/2011 | Shirai | C08G 63/00 430/109.1 |
| 2015/0153668 | A1 * | 6/2015 | Tanaka | G03G 9/0804 430/109.3 |
| 2015/0153669 | A1 * | 6/2015 | Yoshida | G03G 9/0804 430/109.3 |

FOREIGN PATENT DOCUMENTS

| | | | |
|---|---|---|---|
| JP | 2006-106727 | A | 4/2006 |
| JP | 2012-255957 | A | 12/2012 |

OTHER PUBLICATIONS

Harazaki, "Basic Coating Science", 1977, 1st Ed., p. 54-57 (with partial translation).

U.S. Appl. No. 14/555,525, filed Nov. 26, 2014. Inventor: Naoya Isono, et al.

U.S. Appl. No. 14/554,802, filed Nov. 26, 2014. Inventor: Shintaro Noji, et al.

U.S. Appl. No. 14/555,530, filed Nov. 26, 2014. Inventor: Yu Yoshida, et al.

U.S. Appl. No. 14/554,832, filed Nov. 26, 2014. Inventor: Masatake Tanaka, et al.

* cited by examiner

TONER

BACKGROUND OF THE INVENTION

1. Field of the Invention

The present invention relates to a toner that is used to form a toner image by the development of the electrostatic latent image formed by methods such as electrophotographic methods, electrostatic recording methods, and toner jet recording methods.

2. Description of the Related Art

There has been demand in recent years for a reduction in printer and copier power consumption and improvements in toner properties. On the other hand, there has also been demand for problem-free use in a variety of environments. Meeting both of these demands requires the resolution of a trade-off relationship, i.e., suppressing property changes during high-temperature storage while also having the toner soften at lower temperatures. To respond to this problem, investigations have been carried out into toners that incorporate a crystalline resin that exhibits an excellent thermal responsiveness, i.e., an excellent sharp melt property.

Japanese Patent Application Laid-open No. 2006-106727 provides a toner in which lamellar crystals of a crystalline polyester are present in spherical form at the toner surface and in its interior.

With this toner, the heat-resistant storability is maximally maintained through maintenance of the crystallinity of the crystalline polyester in the toner, while the toner readily collapses during fixing due to liquefaction of the crystalline polyester, resulting in an improved low-temperature fixability of the toner. These effects serve to resolve the trade-off relationship cited above. However, in particular during high-speed fixing, the crystalline polyester present in spherical form and the toner binder do not melt uniformly, and not only is a satisfactory low-temperature fixability then not obtained, but during high-speed fixing a phenomenon can occur in which a portion of the toner undergoes melt adhesion to the fixing roller (hot offset phenomenon).

Japanese Patent Application Laid-open No. 2012-255957 provides a toner that has a core/shell structure and that contains a crystalline polyester and a styrene-acrylic resin as binder resins.

With this toner, an improvement in the hot offset phenomenon is pursued by utilizing the elasticity of the styrene-acrylic resin. However, the compatibility between the crystalline polyester and styrene-acrylic resin, which is the toner binder, has not been thoroughly considered. As a result, the toner does not undergo uniform melting during fixing and a satisfactory low-temperature fixability may not be obtained. Japanese Patent Application Laid-open No. Sho 63-27855 and Japanese Patent Application Laid-open No. Sho 62-273574 provide toners that use a block polymer in which a crystalline polyester is bonded to an amorphous polymer that is substantially incompatible.

With these toners, however, when this block polymer is used as the main component, the probability that the crystalline polyester will be present at the toner surface is high and it is quite difficult to cope with speeding up the development system. In addition, with regard to the case in which another resin is made the main component and this block polymer is added, the compatibility between the other polymer and the block polymer has not been thoroughly considered and in some instances it has not been possible to achieve a satisfactory low-temperature fixability.

Thus, while the fixing properties provided by the addition of a crystalline resin have been satisfactorily utilized in these crystalline resin-containing toners, a toner has yet to be introduced that suppresses the adverse effects on the storability and the developing performance.

SUMMARY OF THE INVENTION

The present invention provides a toner that solves the problems heretofore encountered as described above. Thus, the present invention provides a toner that is capable of low-energy fixing even in high-speed fixing systems and that has a satisfactory heat-resistant storability and a satisfactory developing performance.

The toner of the present invention is a toner that comprises a toner particle that contains a binder resin, wherein:

the binder resin contains a styrene-acrylic resin and a crystalline resin, the crystalline resin is a block polymer or a graft polymer which has a crystalline segment and an amorphous segment, the mass ratio between the crystalline segment and an amorphous segment is from 30:70 to 90:10, and wherein, in a total heat flow of the binder resin obtained by measuring the binder resin with a temperature-modulated differential scanning calorimeter (MDSC), a peak temperature of an endothermic peak is from at least 55.0° C. to not more than 90.0° C., and the percentage of an endothermic quantity of the endothermic peak in a reversing heat flow with respect to an endothermic quantity of the endothermic peak in the total heat flow is from at least 0.0% to not more than 35.0%.

The present invention can provide a toner that has a satisfactory heat-resistant storability and a satisfactory developing performance and that makes possible low-energy fixing even in a high-speed fixing system.

Further features of the present invention will become apparent from the following description of exemplary embodiments (with reference to the attached drawings).

DESCRIPTION OF THE EMBODIMENTS

Considering the background given above, the present inventors carried out intensive and extensive investigations focusing on the compatibility between the crystalline resin and binder resin upon melting. As a result, they discovered that a high compatibility between the crystalline resin and binder resin upon melting and a very good fixing performance are exhibited by a toner for which the percentage of the endothermic quantity of an endothermic peak in a reversing heat flow, as measured with a temperature-modulated differential scanning calorimeter (MDSC), satisfies the range given for the present invention.

Measurement with a temperature-modulated differential scanning calorimeter (MDSC) is a differential scanning calorimetric measurement technique in which the amount of heat is measured when temperature raising is performed by superimposing temperature raising/temperature lowering (modulation waveform) with a prescribed frequency on an ordinary temperature raising. The temperature raising waveform used in the present invention is shown in FIG. 1.

Figure 2:
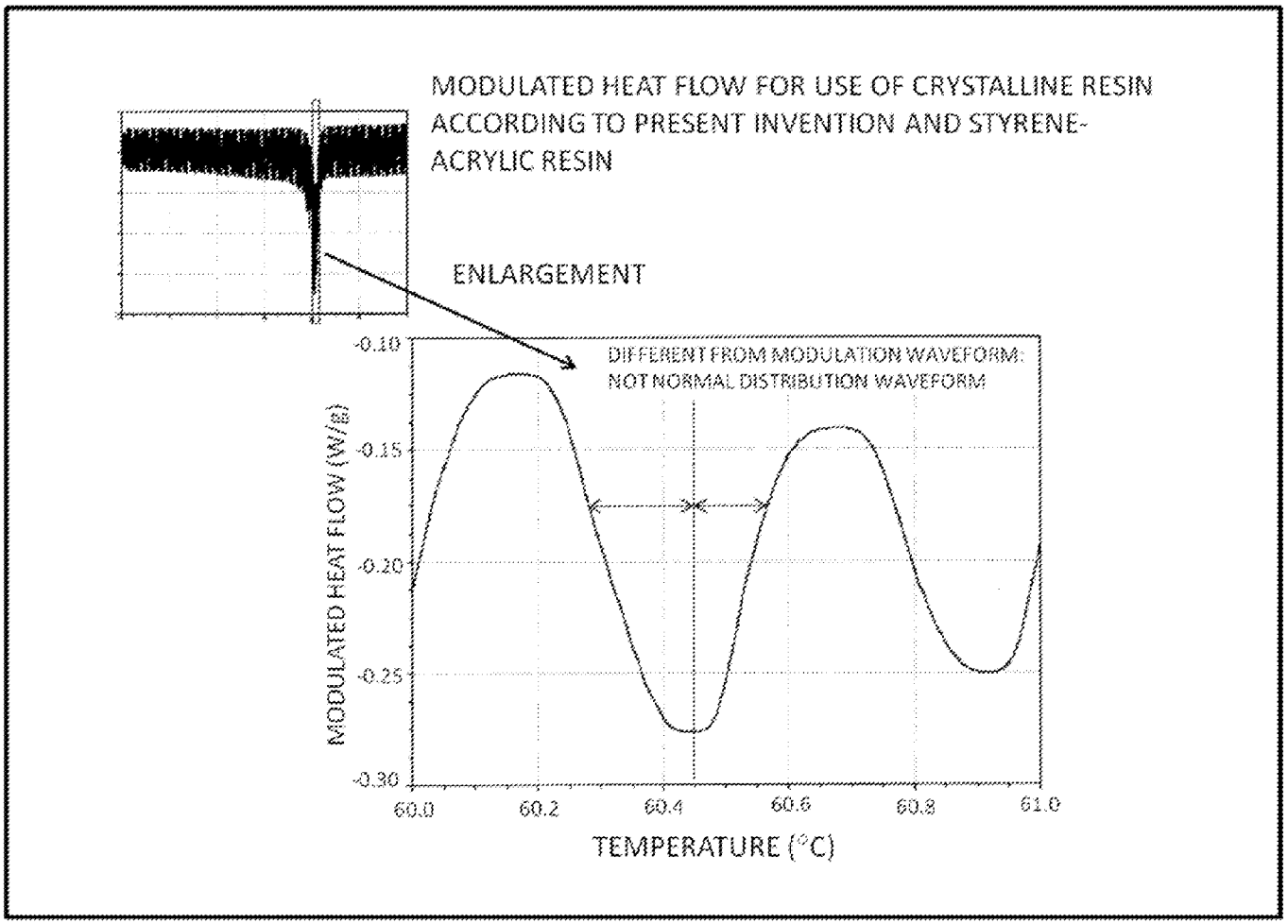
FIG. 2 is a diagram that shows the results of an MDSC measurement in the present invention.
Figure 3:
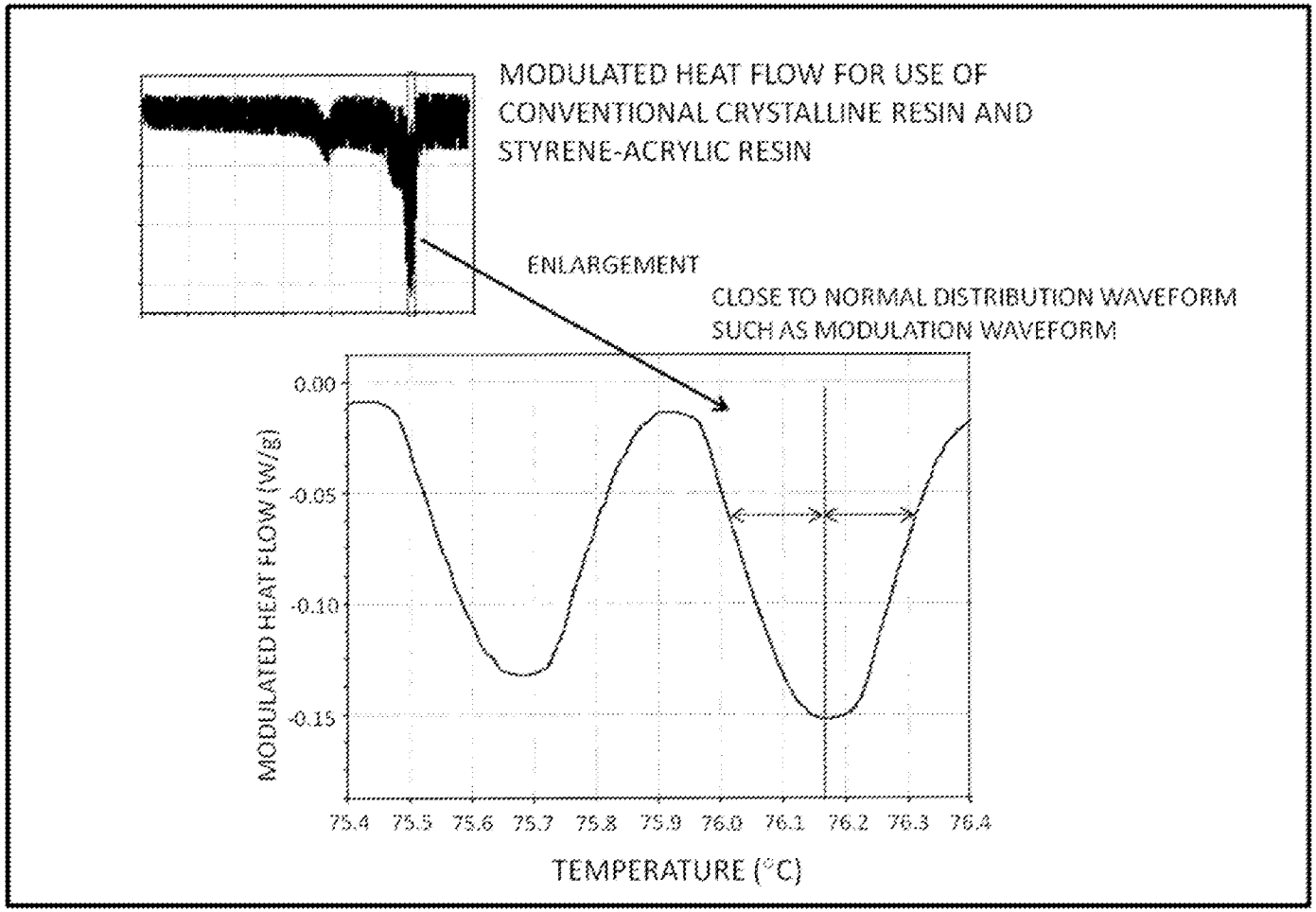
FIG. 3 is a diagram that shows the results of an MDSC measurement in a conventional example.

The results of an MDSC measurement for the use of styrene-acrylic resin and crystalline resin according to the present invention is shown in FIG. 2. This measurement result is the signal prior to analysis to give the total heat flow and is denoted as the modulated heat flow signal on the analytical software (Universal Analysis 2000 from TA Instruments). Based on these measurement results, it was found that the shape of the temperature raising waveform is substantially different from the shape of the endothermic waveform for the crystalline resin, and, when the analysis was performed, the percentage of the endothermic quantity of the endothermic peak in the reversing heat flow was found to be very low. The measurement results for the use of a conventional crystalline resin are given in FIG. 3. These measurement results showed that the shape of the temperature raising waveform was the same as the shape of the endothermic waveform of this crystalline resin, and the results of analysis showed that the percentage of the endothermic quantity of the endothermic peak in the reversing heat flow was very high. That is, it is shown that the percentage of the endothermic quantity of the endothermic peak in the reversing heat flow represents the followability to the modulation waveform for a change in the properties of the crystalline resin. In addition, a lower percentage of the endothermic quantity of the endothermic peak in the reversing heat flow indicates a lower followability to temperature.

Figure 1:
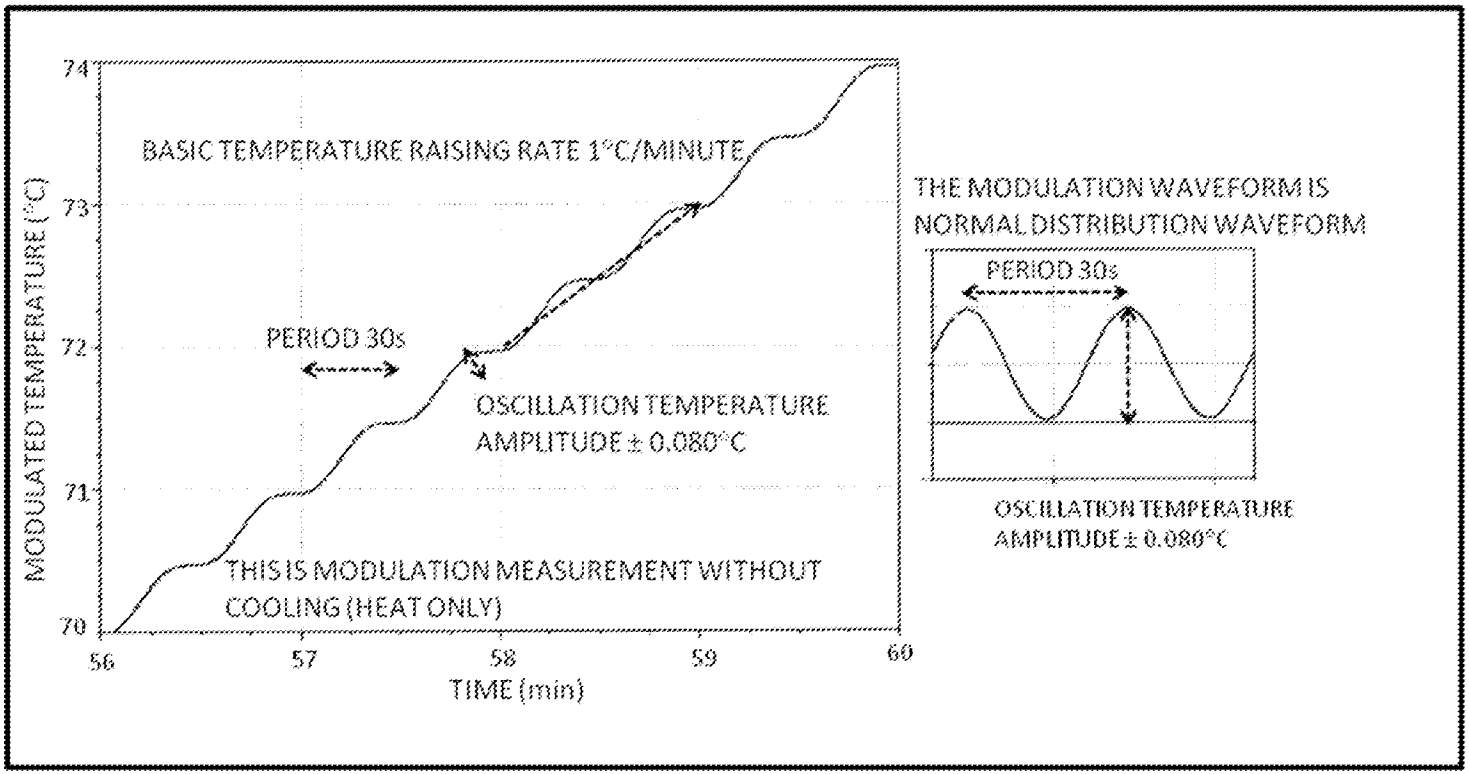
FIG. 1 is the temperature raising waveform used in the MDSC measurements in the present invention.

Since the temperature raising waveform used by the present invention is established so no cooling process is produced by the modulation waveform as shown in FIG. 1, this property change for the crystalline resin is thought to be associated mainly with the melting of the crystalline resin.

When the MDSC measurement of the crystalline segment of the crystalline resin used by the present invention was performed, it was confirmed that the melting of the crystalline segment itself occurred at a rate that was in good followability to the aforementioned temperature raising waveform. Notwithstanding this, the present inventors hold as follows with regard to the appearance of the difference noted above for the combination of styrene-acrylic resin with the crystalline resin.

Thus, for the combination of a styrene-acrylic resin with a crystalline resin in accordance with the present invention, it was thought that the crystalline resin does not just undergo simple melting, but also is compatible with the styrene-acrylic resin and causes plasticization of the styrene-acrylic resin.

Figure 4:
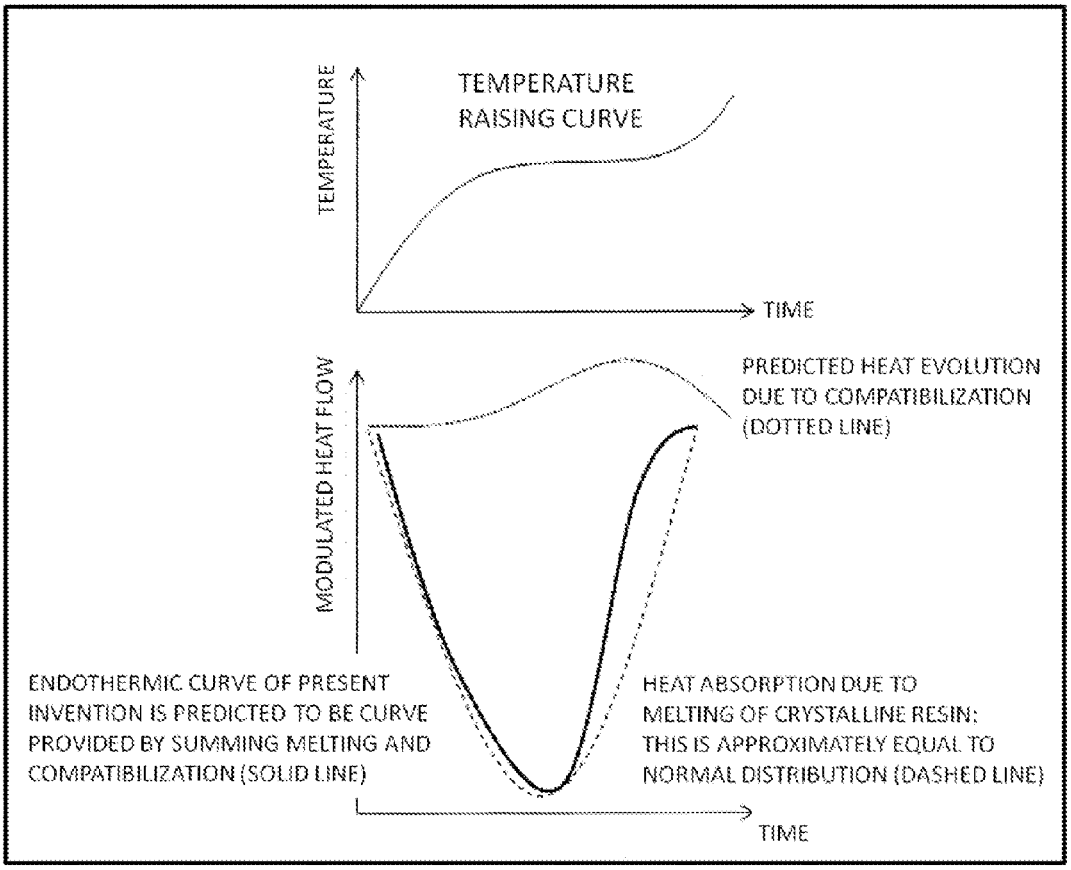
FIG. 4 is a schematic diagram that explains the results of an MDSC measurement in the present invention.

Since this plasticization phenomenon is a compatibilization phenomenon between polymers, heat is frequently evolved (Reference; Polymer Blend, CMC Publishing Co., Ltd., pages 18 and 122). It can be expected that this compatibilization phenomenon does not occur as rapidly as melting of the crystalline resin and exhibits a strong time dependence. It is thought that the modulated heat flow signal characteristic of the present invention appears because the exothermic reaction due to the compatibilization phenomenon occurs at the same time as the melting of the crystalline resin. Specifically, as shown in the schematic diagram in FIG. 4, it was thought that the crystalline resin melts as the temperature raises and heat is absorbed, but that when the temperature raising rate has declined due to the modulation waveform, a waveform is assumed that has been influenced by the heat evolved by the compatibilization phenomenon and, as a result, the percentage of the endothermic quantity of the endothermic peak in the reversing heat flow declines.

Considered more specifically, for the combination of a styrene-acrylic resin with a crystalline resin in accordance with the present invention, as indicated above the percentage of the endothermic quantity of the endothermic peak in the reversing heat flow with respect to the endothermic quantity of the endothermic peak in the total heat flow is low. From the standpoint of the DSC analysis, this low reversing heat flow percentage means that there is a low followability of the endothermic peak to the modulation waveform and hence a large divergence from the normal distribution waveform. Since in the present invention a compatibilization phenomenon is produced as described above at the same time as melting of the crystalline resin, it is thought that the endothermic waveform diverges from a normal distribution due to the heat generated by this compatibilization phenomenon (schematic diagram in FIG. 4). That is, for the combination of a styrene-acrylic resin with a crystalline resin in accordance with the present invention, this means that the compatibility upon melting is high and a satisfactory plasticizing effect by the crystalline resin is obtained.

In order to confirm whether a compatibilization phenomenon is actually produced, the molten state was checked for toner that used a styrene-acrylic resin plus crystalline resin according to the present invention and a state was confirmed in which uniform melting occurred without separation. In addition, when a conventional crystalline resin was used, separation between the crystalline resin and styrene-acrylic resin upon melting was confirmed.

By using the styrene-acrylic resin and crystalline resin in accordance with the present invention, the occurrence of the offset phenomenon can be inhibited—even during high-temperature fixing—while the low-temperature fixing effect due to the crystalline resin can still be satisfactorily manifested. Moreover, the image that is formed has an excellent bending strength because it is formed by polymer in which the two types of polymer are thoroughly compatibilized.

As noted in the preceding, it was recognized that a low percentage of the endothermic quantity of the endothermic peak in the reversing heat flow in MDSC measurement is indicative of compatibility upon melting and is a physical property that is connected to an excellent fixing performance. This was discovered as a result of repeating physical property measurements under a variety of conditions with a variety of samples and could not have possibly been achieved with the prior art or from the heretofore operative perspective.

The binder resin contains a styrene-acrylic resin and a crystalline resin in the present invention.

This binder resin preferably contains the styrene-acrylic resin as its main component.

In addition, the crystalline resin is a block polymer or a graft polymer which has a crystalline segment and an amorphous segment, the mass ratio between the crystalline segment and the amorphous segment is from 30:70 to 90:10.

This is necessary in order to bring about a microdispersion of the crystalline resin in the toner in order to thoroughly exploit the compatibility upon the melting of this toner. When the crystalline segment is present at less than the indicated range, it becomes difficult to maintain the crystalline state of the crystalline resin when it is added to the toner and the heat resistance and development performance then decline. When the crystalline segment is present at greater than the indicated range, the crystalline resin does not undergo a satisfactory microdispersion in the toner and compatibilization upon melting does not proceed to a satisfactory degree.

The mass ratio between the crystalline segment and the amorphous segment is preferably from 40:60 to 80:20 and is more preferably from 40:60 to 70:30.

The mass ratio between the crystalline segment and the amorphous segment can be adjusted through the material proportions and polymerization conditions during production of the crystalline resin. The method for measuring the mass ratio between the crystalline segment and the amorphous segment is described below.

Here, the "styrene-acrylic resin as the main component" means that at least 50 mass % of the binder resin is styrene-acrylic resin. The binder resin in the present invention preferably contains styrene-acrylic resin as the main component, but in this case it may also contain a binder resin used in heretofore known toners in a range in which the effects of the present invention are not impaired.

Styrene-acrylic resin is also preferred for use as a toner binder resin from the standpoints of the charging performance and flowability. However, it frequently has a low compatibility with, for example, crystalline polyester, and it may be said that these can be made to co-exist by the present invention.

The general definition of a block polymer is a polymer structured of a plurality of linearly connected blocks (The Society of Polymer Science, Japan; Glossary of Basic Terms in Polymer Science by the Commission on Macromolecular Nomenclature of the International Union of Pure and Applied Chemistry), and the present invention also operates according to this definition.

The general definition of a graft polymer is a polymer that has one species of block or a plurality of species of blocks bonded as side chains to the main chain of a particular polymer wherein these side chains have a structural (chemical structural) or configurational feature different from the main chain (also from the Glossary referenced above), and the present invention also operates according to this definition.

The peak temperature of an endothermic peak in the total heat flow measured for the binder resin with a temperature-modulated differential scanning calorimeter (MDSC) is from at least 55.0° C. to not more than 90.0° C. in the present invention and is preferably from at least 60.0° C. to not more than 90.0° C.

A decline in the heat resistance of the toner is suppressed when this peak temperature for the endothermic peak is at least 55.0° C. When, on the other hand, the peak temperature of the endothermic peak is not more than 90.0° C., the crystalline resin undergoes thorough melting during the fixing process and a decline in the low-temperature fixability is suppressed.

The peak temperature of the endothermic peak can be controlled through the following properties: the monomer composition used for the crystalline resin, the mass ratio between the crystalline segment and amorphous segment in the crystalline resin, and the molecular weight of the crystalline resin.

The percentage of the endothermic quantity of the endothermic peak in the reversing heat flow with respect to the endothermic quantity of the endothermic peak in the total heat flow is from at least 0.0% to not more than 35.0% in the present invention, in the total heat flow of the binder resin obtained by measuring the binder resin with a temperature-modulated differential scanning calorimeter (MDSC). As noted above, this indicates a high compatibility upon melting between the crystalline resin and the styrene-acrylic resin. When this percentage assumes a value higher than 35.0%, the compatibility upon melting is low and as a consequence the low-temperature fixing effect due to the addition of the crystalline resin is not adequately expressed.

In addition, the crystalline resin separates from the styrene-acrylic resin during high-temperature fixing and the offset phenomenon is prone to occur. Moreover, the resulting fixed image takes on a phase-separated state and the problem of cracking upon bending then readily occurs as a consequence.

A preferred range for this percentage is from at least 0.0% to not more than 30.0%.

This percentage of the endothermic quantity of the endothermic peak in the reversing heat flow can be controlled through the composition of the crystalline resin and the composition of the styrene-acrylic resin, but within this context is conveniently controlled through the composition of the crystalline segment of the crystalline resin and the mass ratio between the crystalline segment and the amorphous segment.

The method of mixing the crystalline resin with the styrene-acrylic resin, the method of producing the styrene-acrylic resin, and the MDSC measurement method are described below.

The crystalline resin in the present invention is preferably a block polymer in which the crystalline segment is a polyester and the amorphous segment is a vinyl polymer.

Having the crystalline segment be a polyester facilitates a design in which the compatibility with the styrene-acrylic resin co-exists in good balance with maintenance of the crystallinity when added to the toner. Moreover, when a release agent is used in the toner, having the crystalline segment be a polyester makes it easy to also achieve phase separation between the release agent and crystalline resin at the same time and thus to improve toner releasability even further.

Having the amorphous segment be a vinyl polymer facilitates maintenance of a state in which the crystalline resin is microdispersed in the styrene-acrylic resin. In addition, the use of a block polymer makes it possible to bring about a microdispersion of the crystalline resin in micelle form in the styrene-acrylic resin and further improve the low-temperature fixability. Moreover, when a block polymer is used, a configuration is assumed in which the crystalline segment and amorphous segment are connected by the main chain and as a consequence a three-dimensional structure is not assumed, and it is thought that due to this the compatibilization velocity with the styrene-acrylic resin is fast. Obstruction of crystalline segment folding by the amorphous segment is also suppressed, and due to this the recrystallization rate is fast, making a block polymer even more preferred.

With regard to the composition of the vinyl polymer in the present invention, known vinylic monomers can be used, such as styrene, methyl methacrylate, and n-butyl acrylate. In particular, the use of styrene as the major component is more preferred from the standpoint of the compatibility with the styrene-acrylic resin-containing binder resin and the formation of phase-separated structures.

Viewed in terms of having the heat resistance co-exist in good balance with the compatibility with the styrene-acrylic resin upon melting, the crystalline segment in the crystalline resin in the present invention is preferably a polyester segment that has a structure represented by the following formula (1) (the formula (1) unit) and a structure represented by the following formula (2) (the formula (2) unit).

[Chemical formula 1]

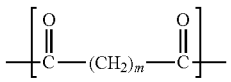

(1)

(m in formula (1) represents an integer from at least 6 to not more than 14 (preferably from at least 7 to not more than 10))

[Chemical formula 2]

$$-\!\!\left[O-(CH_2)_n-O\right]\!\!- \quad (2)$$

(n in formula (2) represents an integer from at least 6 to not more than 16 (preferably from at least 6 to not more than 12))

This polyester segment can be produced from, for example, a dicarboxylic acid represented by the following formula (A), or its alkyl ester or anhydride, and a diol represented by the following formula (B). This polyester segment is produced by their condensation polymerization.

$$HOOC-(CH_2)_m-COOH \quad \text{formula (A)}$$

(m in the formula represents an integer from at least 6 to not more than 14 (preferably from at least 7 to not more than 10))

$$HO-(CH_2)_n-OH \quad \text{formula (B)}$$

(n in the formula represents an integer from at least 6 to not more than 16 (preferably from at least 6 to not more than 12))

As long as the same subskeleton is produced in the polyester segment, the dicarboxylic acid may be used in the form of a compound in which the carboxyl group has been alkyl (having preferably from at least 1 to not more than 4 carbon atoms) esterified or a compound provided by conversion into the anhydride.

By having m and n in the preceding formulas be in the indicated ranges, the compatibility with the styrene-acrylic resin upon melting can be raised even higher. In addition, the crystallinity is readily maintained when added to the toner, and due to this an even better low-temperature fixability can co-exist in good balance with the heat resistance and durability.

The absolute value of the difference between the solubility parameter (SP) values for the styrene-acrylic resin and the crystalline segment of the crystalline resin (ΔSP value) is preferably from at least 0.00 to not more than 0.35 in the present invention. The solubility parameter is generally a value that indicates the general solubility for a polymer, and the closer these values are to one another the higher the compatibility. By obeying the range indicated for the present invention, a high compatibility is obtained upon melting between the styrene-acrylic resin and the crystalline resin and an even better low-temperature fixability, resistance to hot offset, and image bending strength are then obtained. The ΔSP value for the styrene-acrylic resin and the crystalline segment of the crystalline resin is more preferably from at least 0.00 to not more than 0.33.

The absolute value of the difference between the solubility parameter (SP) values for the styrene-acrylic resin and the amorphous segment of the crystalline resin (ΔSP value) is preferably from at least 0.00 to not more than 0.35 and more preferably from at least 0.00 to not more than 0.20. By obeying the indicated range, the crystalline resin readily undergoes microdispersion in the styrene-acrylic resin and the compatibilization effect upon melting is then expressed more rapidly, and as a consequence the toner readily collapses during fixing and a higher gloss image is obtained.

Each of the SP values referenced above can be controlled through the monomer composition used in resin production. The procedure for calculating the SP value is provided below.

The content of the crystalline resin in the binder resin in the toner of the present invention is preferably from at least 2.0 mass % to not more than 50.0 mass % and is more preferably from at least 6.0 mass % to not more than 50.0 mass %. By obeying the indicated range, a satisfactory developing performance can be obtained while at the same time obtaining the effect on low-temperature fixing due to the addition of the crystalline resin. The content of the crystalline resin in the binder resin is more preferably not more than 35.0 mass %.

Viewed from the perspective of controlling the dispersibility of the crystalline resin, the toner particle is preferably produced by a suspension polymerization method in the present invention. While the reasons for this are unclear, the crystalline resin can be dispersed throughout the entire toner particle by carrying out production using a suspension polymerization method and dissolving the crystalline resin in the polymerizable monomer. The previously described compatibilization effect upon melting can be better expressed as a result. In addition, the toner particles readily encapsulate the crystalline resin and a smooth and flat surface is readily obtained and an even better development performance is obtained as a consequence.

The weight-average molecular weight (Mw) of the crystalline resin in the present invention is preferably from at least 15,000 to not more than 45,000 and is more preferably from at least 20,000 to not more than 45,000. By obeying the indicated range, the influence on the heat resistance when the crystalline resin has been added to the toner can be suppressed while compatibilization between the crystalline resin and the styrene-acrylic resin can also occur rapidly. The weight-average molecular weight (Mw) of the crystalline resin is even more preferably from at least 23,000 to not more than 40,000.

The weight-average molecular weight (Mw) of the amorphous segment of the crystalline resin is preferably from at least 5,000 to not more than 15,000 in the present invention. By obeying the indicated range, an even better microdispersion of the crystalline resin in the toner can be achieved. Moreover, an even better heat resistance is obtained because the glass transition temperature (° C.) of the amorphous segment can be satisfactorily elevated.

The weight-average molecular weight (Mw) of the crystalline resin and the amorphous segment of the crystalline resin can be controlled through the synthesis temperature and synthesis time during production of the crystalline resin. The method of measuring the weight-average molecular weight (Mw) of the crystalline resin and the amorphous segment of the crystalline resin is described below.

The value of the loss elastic modulus at 100° C. for the crystalline resin is preferably from at least 100 (Pa) to not more than 10,000 (Pa) in the present invention. Obeying the indicated range serves to inhibit the occurrence of phase separation between the crystalline resin and the styrene-acrylic resin upon melting while also maintaining the sharp melt property of the crystalline resin. As a result, an even better low-temperature fixability and resistance to hot offset can co-exist in good balance. The value of the loss elastic modulus at 100° C. can be controlled through the molecular weight and composition of the crystalline resin. The method of measuring the value of the loss elastic modulus at 100° C. is described below.

A method of producing the toner particle of the present invention is specifically described below using examples of the procedure and examples of the materials that may be used, but this should not be construed as a limitation to the following.

The toner particle of the present invention may be produced by any production method, but a production method that uses suspension polymerization, which is the most preferred procedure, is described in the following.

A polymerizable monomer composition is prepared by mixing the crystalline resin and the polymerizable monomer that will form the styrene-acrylic resin and dissolving or dispersing these to uniformity using a dispersing device such as, for example, a homogenizer, ball mill, colloid mill, or ultrasonic disperser. When this is done, the following may be added as necessary and appropriate to the polymerizable monomer composition: colorant, release agent, polar resin, polyfunctional monomer, pigment dispersing agent, charge control agent, solvent to adjust the viscosity, and other additives (for example, a chain transfer agent).

This polymerizable monomer composition is then introduced into a preliminarily prepared aqueous medium that contains a dispersion stabilizer, and suspension and granulation are performed using a high-speed dispersing device such as a high-speed stirrer or an ultrasound disperser.

A polymerization initiator may be mixed along with the other additives when the polymerizable monomer composition is prepared and may be mixed into the polymerizable monomer composition immediately before suspension in the aqueous medium. In addition, the polymerization initiator may as necessary also be added dissolved in polymerizable monomer or another solvent, during granulation or after the completion of granulation, i.e., immediately before the start of the polymerization reaction.

After granulation, the suspension is heated and a polymerization reaction is run while stirring so as to maintain the particles of the polymerizable monomer composition in a particulate state in the suspension and prevent the occurrence of particle flotation or sedimentation. The polymerization reaction is brought to completion to form an aqueous dispersion of the toner particles, as necessary with the execution of a solvent removal process.

After this, the toner can be obtained by performing washing as necessary and carrying out drying, classification, and external addition by known methods.

A radical-polymerizable vinylic polymerizable monomer may be used as the polymerizable monomer constituting the styrene-acrylic resin. A monofunctional polymerizable monomer or a polyfunctional polymerizable monomer can be used as this vinylic polymerizable monomer.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butyleneglycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

With regard to these monomers, a single monofunctional polymerizable monomer may be used or a combination of two or more may be used; or, a combination of monofunctional polymerizable monomer and polyfunctional polymerizable monomer may be used; or, a single polyfunctional polymerizable monomer may be used or a combination of two or more may be used.

Besides those already indicated above, resins used as binder resins in ordinary toners, such as styrene-acrylic resins, (meth)acrylic resins, polyester resins, and urethane resins, may also be used in the present invention as the polymers constituting the crystalline segment and amorphous segment of the crystalline resin. However, the use of a polyester as the crystalline segment and a vinyl polymer as the amorphous segment as described above is preferred.

This polyester resin can be obtained by the reaction of a diol with a dibasic or higher basic polybasic carboxylic acid. When a polyester resin is used for the crystalline resin, there is a limitation, among the monomers provided as examples below, to monomers that, once polymerized, give a clear endothermic peak in DSC measurements.

A known alcohol monomer can be used as the alcohol monomer for obtaining this polyester resin. In specific terms, for example, the following can be used: alcohol monomers such as ethylene glycol, diethylene glycol, and 1,2-propylene glycol; divalent aromatic alcohols such as polyoxyethylene-modified bisphenol A; aromatic alcohols such as 1,3,5-tris (hydroxymethyl)benzene; and polyvalent alcohols such as pentaerythritol.

A known carboxylic acid monomer can be used as the carboxylic acid monomer for obtaining the polyester resin. In specific terms, for example, the following can be used: dicarboxylic acids such as oxalic acid and sebacic acid and the anhydrides and lower alkyl esters of these acids; and tribasic or higher basic polybasic carboxylic acid components such as trimellitic acid, 2,5,7-naphthalenetricarboxylic acid, 1,2,4-naphthalenetricarboxyic acid, pyromellitic acid, 1,2,4-butanetricarboxylic acid, 1,2,5-hexanetricarboxylic acid, and 1,3-dicarboxyl-2-methyl-2-methylenecarboxypropane and their derivatives such as the anhydrides and lower alkyl esters.

In the present invention, the monomers usable for the previously described styrene-acrylic resin may also be used for the monomers usable for the crystalline segment and for the vinyl polymer serving as the amorphous segment. When a vinyl polymer is used for the crystalline resin, there is a limitation, among the monomers taught in this Specification, to monomers that, once polymerized, give a clear endothermic peak in DSC measurements.

The toner particle in the present invention may contain a colorant. A known colorant may be used as this colorant, such as the various heretofore known dyes and pigments.

The following can be used as a black colorant: carbon black, magnetic bodies, and black colorants provided by color mixing using the yellow, magenta, and cyan colorants described below to give a black color. For example, the following colorants can be used as colorants for cyan toners, magenta toners, and yellow toners.

Compounds as represented by monoazo compounds, disazo compounds, condensed azo compounds, isoindolinone compounds, anthraquinone compounds, azo metal complexes, methine compounds, and allylamide compounds are used as pigment for the yellow colorant. Specific examples are C. I. Pigment Yellow 74, 93, 95, 109, 111, 128, 155, 174, 180, and 185.

Monoazo compounds, condensed azo compounds, diketopyrrolopyrrole compounds, anthraquinone, quinacridone compounds, basic dye lake compounds, naphthol compounds, benzimidazolone compounds, thioindigo compounds, and perylene compounds are used as the magenta colorant. Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C. I. Pigment Violet 19.

Copper phthalocyanine compounds and their derivatives, anthraquinone compounds, and basic dye lake compounds can be used as the cyan colorant. Specific examples are C. I. Pigment Blue 1, 7, 15, 15:1, 15:2, 15:3, 15:4, 60, 62, and 66.

The colorant is preferably used at from 1.0 mass parts to 20.0 mass parts per 100.0 mass parts of the binder resin.

A magnetic body may be incorporated in the toner particle when the toner of the present invention is used as a magnetic toner. In this case the magnetic body may also take on the role of a colorant. The magnetic body can be exemplified in the present invention by iron oxides such as magnetite, hematite, and ferrite, and by metals such as iron, cobalt, and nickel. Other examples are alloys of these metals with metals such as aluminum, cobalt, copper, lead, magnesium, tin, zinc, antimony, beryllium, bismuth, cadmium, calcium, manganese, selenium, titanium, tungsten, and vanadium, and their mixtures.

The toner particle in the present invention may contain a release agent. There are no particular limitations on this release agent and known release agents can be used. The following compounds are examples: aliphatic hydrocarbon waxes such as low molecular weight polyethylene, low molecular weight polypropylene, microcrystalline wax, paraffin wax, and Fischer-Tropsch wax; the oxides of aliphatic hydrocarbon waxes, such as oxidized polyethylene wax, and their block copolymers; waxes in which the major component is a fatty acid ester, such as carnauba wax, sasol wax, ester wax, and montanic acid ester wax; the products of the partial or complete deacidification of fatty acid esters, such as deacidified carnauba wax; waxes provided by grafting, using a vinylic monomer such as styrene or acrylic acid, onto an aliphatic hydrocarbon wax; the partial esters of polyhydric alcohols and fatty acids, such as behenyl monoglyceride; and the hydroxyl group-containing methyl ester compounds obtained by, for example, the hydrogenation of vegetable fats and oils.

The release agent is preferably used at from 1.0 mass parts to 30.0 mass parts per 100.0 mass parts of the binder resin.

The toner particle in the present invention may contain a charge control agent. The use is preferred thereamong of a charge control agent that controls the toner particle to negative charging. Examples of this charge control agent are provided below.

Examples are organometal compounds, chelate compounds, monoazo metal compounds, acetylacetone metal compounds, urea derivatives, metal-containing salicylic acid-type compounds, metal-containing naphthoic acid-type compounds, quaternary ammonium salts, calixarene, silicon compounds, and metal-free carboxylic acid compounds and their derivatives. Sulfonic acid resins having a sulfonic acid group, sulfonate salt group, or sulfonate ester group may also be favorably used.

The amount of addition for the charge control agent is preferably from 0.01 mass parts to 20.0 mass parts per 100.0 mass parts of the binder resin.

The toner particle in the present invention may contain a polar resin. Polyester-type resins and carboxyl-containing styrenic resins are preferred for this polar resin. By using a polyester-type resin or carboxyl-containing styrenic resin for the polar resin, these resins are unevenly distributed to the surface of the toner particle to form a shell and the lubricity intrinsic to these resins can be expected. The content of the polar resin is preferably from 1.0 mass parts to 20.0 mass parts per 100.0 mass parts of the binder resin.

A known surfactant or organic dispersing agent or inorganic dispersing agent can be used in the present invention as a dispersion stabilizer that is added to the aqueous dispersion referenced above. With inorganic dispersing agents, the production of ultramicrofine particles is inhibited, stability disruptions due to the polymerization temperature or passage of time are suppressed, and they are easily washed out thereby suppressing negative effects on the toner, and as a consequence inorganic dispersing agents can be favorably used among the preceding. The inorganic dispersing agent can be exemplified by multivalent metal salts of phosphoric acid, such as tricalcium phosphate, magnesium phosphate, aluminum phosphate, and zinc phosphate; carbonate salts such as calcium carbonate and magnesium carbonate; inorganic salts such as calcium metasilicate, calcium sulfate, and barium sulfate; and inorganic oxides or inorganic hydroxides such as calcium hydroxide, magnesium hydroxide, aluminum hydroxide, silica, bentonite, and alumina. After the completion of the polymerization, these inorganic dispersing agents can be almost completely removed by decomposition through the addition of acid or alkali.

The external addition of a flowability improver to the toner in the present invention is preferred in order to improve image quality. For example, the toner of the present invention can be obtained by the external addition of finely divided inorganic particles, infra, to the toner particles and inducing their attachment to the toner particle surface. A known method may be used as the method for the external addition of the finely divided inorganic particles. An example here is a method that performs a mixing process using a Henschel mixer (Mitsui Miike Chemical Engineering Machinery Co., Ltd.). Finely divided inorganic particles of titanium oxide or aluminum oxide or finely divided silicic acid particles are favorably used as this flowability improver. These finely divided inorganic particles are preferably subjected to a hydrophobic treatment with a hydrophobic agent such as a silane coupling agent, silicone oil, or their mixture. As necessary, an external additive other than a flowability improver may also be mixed in the toner particles in the toner of the present invention.

The total amount of addition of the finely divided inorganic particles is preferably from 1.0 mass parts to 5.0 mass parts per 100.0 mass parts of the toner particles.

The toner of the present invention may be used as such as a single-component developer or may be mixed with a magnetic carrier and used as a two-component developer.

The methods for measuring the various physical property values specified in the present invention are described in the following.

<Method for Measuring the Mass Ratio Between the Crystalline Segment and the Amorphous Segment in the Crystalline Resin (the C/A Ratio)>

The mass ratio between the crystalline segment and the amorphous segment in the crystalline resin (the C/A ratio) was measured using nuclear magnetic resonance spectroscopy ($^1$H-NMR) [400 MHz, $CDCl_3$, room temperature (25° C.)]

measurement instrumentation: JNM-EX400 FT-NMR instrument (JEOL Ltd.)
measurement frequency: 400 MHz
pulse condition: 5.0 μs
frequency range: 10500 Hz
number of integrations: 64

The mass ratio between the crystalline segment and the amorphous segment (the C/A ratio) was calculated from the integration values in the obtained spectrum.

<Separation of the Binder Resin and Release Agent from the Toner by Preparative Gel Permeation Chromatography (GPC)>

The toner is dissolved in tetrahydrofuran (THF) and the solvent is distilled from the soluble matter under reduced pressure to obtain the tetrahydrofuran (THF)-soluble component of the toner.

This tetrahydrofuran (THF)-soluble component of the toner is dissolved in chloroform to prepare a sample solution having a concentration of 25 mg/mL.

3.5 mL of the obtained sample solution is injected into the instrument indicated below and a low molecular weight component deriving from the release agent and having a molecular weight of less than 2,000 is fractionated from a high molecular weight component deriving from the binder resin and having a molecular weight of at least 2,000.

preparative GPC instrument: Preparative HPLC Model LC-980 from Japan Analytical Industry Co., Ltd.
preparative column: JAIGEL 3H, JAIGEL 5H (Japan Analytical Industry Co., Ltd.)
eluent: chloroform
flow rate: 3.5 mL/minute After the high molecular weight component deriving from the binder resin has been fractionated, the solvent is distilled off under reduced pressure and drying is carried out for 24 hours under reduced pressure in a 90° C. atmosphere. This procedure is repeated until about 100 mg of the binder resin component is obtained.

<Separation of the Styrene-Acrylic Resin and Crystalline Resin from the Binder Resin>

500 mL acetone is added to 100 mg of the binder resin provided by the procedure indicated above and complete dissolution is carried out by heating to 70° C. This is followed by gradual cooling to 25° C. to recrystallize the crystalline resin. The crystalline resin is suction filtered to effect separation into the crystalline resin and a filtrate.

The separated filtrate is then gradually added to 500 mL methanol in order to reprecipitate the styrene-acrylic resin. The styrene-acrylic resin is subsequently recovered with a suction filter.

The obtained styrene-acrylic resin and crystalline resin are dried under reduced pressure for 24 hours at 40° C.

<Measurement with a Temperature-Modulated Differential Scanning Calorimeter (MDSC)>

This measurement is performed based on ASTM D 3418-82 using a "Q1000" differential scanning calorimeter (TA Instruments). Universal Analysis 2000 (TA Instruments) analytical software is used for the analysis.

The melting points of indium and zinc are used for temperature correction in the instrument detection section, and the heat of fusion of indium is used for correction of the amount of heat.

Specifically, 2 mg of the binder resin (sample) fractionated from the toner by the procedure described above is accurately weighed out and is introduced into the aluminum pan. Using an empty aluminum pan as the reference, a modulation measurement is run using the following settings: temperature raising rate=1° C./minute in the measurement temperature range from 0° C. to 120° C., period=30 s, oscillation temperature amplitude±0.080° C. During this temperature raising process, changes are obtained in the specific heat in the temperature range from 0° C. to 120° C.

These conditions are conditions for isolating the melting of the crystalline resin and the compatibilization phenomenon between the crystalline resin and styrene-acrylic resin upon melting. They are also conditions with which cooling is not produced by the modulation so recrystallization of the crystalline resin during the measurement does not occur. The period is 30 s. At less than 30 s, melting by the crystalline resin itself cannot follow for a portion of the crystalline resin and isolation from the compatibilization phenomenon is then quite problematic. At longer than 30 s, this compatibilization phenomenon may also become followable and isolation likewise becomes quite problematic.

In the total heat flow signal in the measurement results, the temperature at the apex of the endothermic curve originating with the crystalline resin is designated the peak temperature (° C.) [Tm] of the endothermic peak, while the endothermic quantity (J/g) of this endothermic peak is designated the endothermic quantity (J/g) in the total heat flow. In addition, in the reversing heat flow signal in the measurement results, the endothermic quantity (J/g) is analyzed in the same temperature range as the temperature range analyzed in the total heat flow signal, and this is designated the endothermic quantity (J/g) of the endothermic peak in the reversing heat flow. The percentage (%) of the endothermic quantity of the endothermic peak in the reversing heat flow [reversing heat flow percentage (%)] is then calculated by dividing this endothermic quantity (J/g) of the endothermic peak in the reversing heat flow by the endothermic quantity (J/g) of the endothermic peak in the total heat flow and multiplying the resulting value by 100.

For the glass transition temperature (Tg) of the toner particle, the measurement described above is run on the toner particle, and the glass transition temperature (Tg) of the toner particle is taken to be the temperature at the intersection between the curve segment for the stepwise change at the glass transition and the straight line that is equidistant, in the direction of the vertical axis, from the straight lines formed by extending the baselines for prior to and subsequent to the appearance of the change in the specific heat in the curve for the reversible specific heat change.

To obtain the aforementioned measurement value from the toner, the measurement may be carried out using the binder resin after separating the release agent from the binder resin by the process described above.

<Method of Calculating the SP Value>

The SP value was calculated in the present invention using equation (1) of Fedors. Here, for the values of Δei and Δvi refer to "Energies of Vaporization and Molar Volumes (25° C.) of Atoms and Atomic Groups" in Tables 3 to 9 of "Basic Coating Science" (pp. 54-57, 1986 (Maki Shoten Publishing)).

$$\delta i=[Ev/V]^{(1/2)}=[\Delta ei/\Delta vi]^{(1/2)} \quad \text{Equation (1):}$$

Ev: energy of vaporization

V: molar volume

Δei: energy of vaporization of the atoms or atomic groups of component i

Δvi: molar volume of the atoms or atomic groups of component i

For example, hexanediol is built of (—OH)×2+(—$CH_2$—)×6 atomic groups, and its calculated SP value is determined from the following formula.

$$\delta i=[\Delta ei/\Delta vi]^{\wedge(1/2)}=[\{(5220)\times 2+(1180)\times 6\}/\{(13)\times 2+(16.1)\times 6\}]^{\wedge(1/2)}$$

The SP value (δi) then evaluates to 11.95.

<The Method for Measuring the Molecular Weight>

The weight-average molecular weight (Mw) of, for example, the crystalline resin and the amorphous segment of the crystalline resin, is measured as described in the following by gel permeation chromatography (GPC).

First, the crystalline resin or amorphous segment of the crystalline resin is dissolved in tetrahydrofuran (THF) at room temperature. The resulting solution is filtered across a "MyShoriDisk" solvent-resistant membrane filter (Tosoh Corporation) having a pore diameter of 0.2 μm to obtain a sample solution. This sample solution is adjusted to bring the concentration of the THF-soluble component to 0.8 mass %. The measurement is carried out under the following conditions using this sample solution.

instrument: "HLC-8220GPC" high-performance GPC instrument (Tosoh Corporation)

column: 2×LF-604 (Showa Denko Kabushiki Kaisha)

eluent: THF flow rate: 0.6 mL/minute oven temperature: 40° C.

sample injection amount: 0.020 mL

The molecular weight of the sample is determined using a molecular weight calibration curve constructed using standard polystyrene resins (for example, trade name: "TSK Standard Polystyrene F-850, F-450, F-288, F-128, F-80, F-40, F-20, F-10, F-4, F-2, F-1, A-5000, A-2500, A-1000, A-500", from Tosoh Corporation). The measurement of the molecular weight of the vinyl polymer segment of the crystalline resin is carried out after hydrolysis of the polyester segment of the crystalline resin.

The specific method is as follows. 5 mL of dioxane and 1 mL of a 10 mass % aqueous potassium hydroxide solution are added to 30 mg of the crystalline resin and the polyester segment is hydrolyzed by shaking for 6 hours at a temperature of 70° C. The solution is then dried to prepare a sample for measurement of the molecular weight of the vinyl polymer segment. The ensuing process is carried out as for the crystalline resin.

<Method for Measuring the Loss Elastic Modulus at 100° C.>

An "ARES" rotating plate rheometer (TA Instruments) is used as the measurement instrument.

The measurement sample used is a sample provided by compression molding the crystalline resin into a circular plate with a diameter of 7.9 mm and a thickness of 2.0±0.3 mm, using a tablet molder in a 25° C. environment.

This sample is mounted in the parallel plates; the temperature is raised in 15 minutes from room temperature (25° C.) to 100° C.; the sample shape is trimmed; holding is performed for 10 minutes; and the measurement is then started. The measurement is carried out under the following conditions: temperature=100° C., frequency=1.0 Hz, strain=1.0%.

<Measurement of the Content of the Crystalline Resin in the Binder Resin from the Toner>

The content of the crystalline resin is calculated from the integration values in the nuclear magnetic resonance ($^1$H-NMR) spectrum of the toner based on the individual nuclear magnetic resonance ($^1$H-NMR) spectra for the binder resin and the crystalline resin.

measurement instrument: JNM-EX400 FT-NMR instrument (JEOL Ltd.)

measurement frequency: 400 MHz pulse condition: 5.0 μs frequency range: 10500 Hz number of integrations: 64

<Determination of the Structure of the Styrene-Acrylic Resin, the Crystalline Resin, and the Crystalline Segment of the Crystalline Resin>

The structure of the styrene-acrylic resin, the crystalline resin, and the crystalline segment of the crystalline resin was determined by nuclear magnetic resonance ($^1$H-NMR) [400 MHz, $CDCl_3$, room temperature (25° C.)]

measurement instrument: JNM-EX400 FT-NMR instrument (JEOL Ltd.)

measurement frequency: 400 MHz pulse condition: 5.0 μs frequency range: 10500 Hz number of integrations: 64

EXAMPLES

The present invention is specifically described through the examples provided below, but the present invention is not limited to or by these examples. Unless specifically indicated otherwise, the number of parts and % used in the examples are in all instances on a mass basis.

<Production of Crystalline Resins 1 and 19>

100.0 parts of sebacic acid and 83.0 parts of 1,9-nonanediol were added to a reactor fitted with a stirrer, thermometer, nitrogen introduction tube, water separation tube, and pressure-reduction apparatus, and were heated to a temperature of 130° C. while stirring. 0.7 parts of titanium (IV) isopropoxide was added as an esterification catalyst and the temperature was raised to 160° C. and a condensation polymerization was run. After this, the temperature was raised to 180° C. and the reaction was run while reducing the pressure until the desired molecular weight was reached, this yielding a polyester (1). The weight-average molecular weight (Mw) of polyester (1), as measured by the previously described method, was 19,000, and its melting point (Tm) was 73° C.

A portion of this polyester (1) was taken for use as the crystalline resin 19.

100.0 parts of polyester (1) and 440.0 parts of dry chloroform were then added to a reactor fitted with a stirrer, thermometer, and nitrogen introduction tube. After complete dissolution, 5.0 parts of triethylamine was added and 15.0 parts of 2-bromoisobutyryl bromide was gradually added with ice cooling. This was followed by stirring for 24 hours at room temperature (25° C.)

This resin solution was gradually added dropwise to a vessel holding 550.0 parts of methanol in order to reprecipitate the resin matter, followed by filtration, purification, and drying to obtain a polyester (2).

Then, 100.0 parts of the thusly obtained polyester (2), 100.0 parts of styrene, 3.5 parts of copper(I) bromide, and 8.5 parts of pentamethyldiethylenetriamine were added to a reactor fitted with a stirrer, thermometer, and nitrogen introduction tube, and a polymerization reaction was run at a temperature of 110° C. while stirring. The reaction was stopped once the desired molecular weight was reached, followed by reprecipitation with 250.0 parts of methanol, filtration, purification, and removal of the unreacted styrene and the catalyst. Drying was subsequently carried out with a vacuum dryer set to 50° C. to obtain the crystalline resin 1.

<Production of Crystalline Resins 2 to 20 and 25 to 27>

Crystalline resins 2 to 20 and 25 to 27 were obtained proceeding as in the method for producing crystalline resin 1 and crystalline resin 19, with the exception that starting materials were changed as shown in Table 1.

TABLE 1

| | monomer composition of the crystalline segment | | | | monomer composition of the amorphous segment | |
|---|---|---|---|---|---|---|
| | acid monomer | mass parts | alcohol monomer | mass parts | vinyl monomer | mass parts per 100 parts crystalline segment |
| crystalline resin 1 | sebacic acid | 100.0 | 1,9-nonanediol | 83.0 | styrene | 100.0 |
| crystalline resin 2 | sebacic acid | 100.0 | 1,9-nonanediol | 83.0 | styrene | 180.0 |
| crystalline resin 3 | sebacic acid | 100.0 | 1,9-nonanediol | 83.0 | styrene | 70.0 |
| crystalline resin 4 | sebacic acid | 100.0 | 1,9-nonanediol | 83.0 | styrene | 50.0 |
| crystalline resin 5 | tetradecane dioic acid | 100.0 | 1,12-dodecanediol | 84.0 | styrene | 100.0 |
| crystalline resin 6 | sebacic acid | 100.0 | 1,3-propanediol | 39.5 | styrene | 80.0 |
| crystalline resin 7 | sebacic acid | 100.0 | 1,12-dodecanediol | 106.5 | styrene | 100.0 |
| crystalline resin 8 | sebacic acid | 100.0 | 1,6-hexanediol | 54.5 | styrene | 80.0 |
| crystalline resin 9 | sebacic acid | 100.0 | ethylene glycol | 34.8 | styrene | 100.0 |
| crystalline resin 10 | sebacic acid | 100.0 | 1,9-nonanediol | 83.0 | styren:2EHA 85:15 | 100.0 |
| crystalline resin 11 | sebacic acid | 100.0 | 1,9-nonanediol | 83.0 | styrene:t-BA 28:72 | 100.0 |
| crystalline resin 12 | sebacic acid | 100.0 | 1,9-nonanediol | 83.0 | styrene | 250.0 |
| crystalline resin 13 | sebacic acid | 100.0 | 1,9-nonanediol | 83.0 | styrene | 300.0 |
| crystalline resin 14 | sebacic acid | 100.0 | 1,3-propanediol | 39.5 | styrene | 100.0 |
| crystalline resin 15 | tetradecane dioic acid | 100.0 | 1,12-dodecanediol | 84.0 | styrene | 70.0 |
| crystalline resin 16 | sebacic acid | 100.0 | 1,12-dodecanediol | 106.5 | styrene:t-BA 28:72 | 70.0 |
| crystalline resin 17 | sebacic acid | 100.0 | ethylene glycol | 34.8 | styrene | 70.0 |
| crystalline resin 18 | polyester (1) produced for crystalline resin 8 | | | | | |
| crystalline resin 19 | polyester (1) produced for crystalline resin 1 | | | | | |
| crystalline resin 20 | polyester (1) produced for crystalline resin 7 | | | | | |
| crystalline resin 25 | sebacic acid | 100.0 | 1,9-nonanediol | 83.0 | styrene | 60.0 |
| crystalline resin 26 | sebacic acid | 100.0 | 1,9-nonanediol | 83.0 | styrene | 70.0 |
| crystalline resin 27 | sebacic acid | 100.0 | 1,9-nonanediol | 83.0 | styrene | 70.0 |

In the table, t-BA refers to t-butyl acrylate and 2EHA refers to 2-ethylhexyl acrylate.

<Production of Crystalline Resin 21>

100.0 parts of sebacic acid and 83.0 parts of 1,9-nonanediol were added to a reactor fitted with a stirrer, thermometer, nitrogen introduction tube, water separation tube, and pressure-reduction apparatus, and were heated to a temperature of 130° C. while stirring. 0.7 parts of titanium (IV) isopropoxide was added and the temperature was raised to 150° C. and a condensation polymerization was run for 5 hours. After this, 15.0 parts of acrylic acid and 80.0 parts of styrene were added dropwise over 1 hour. Stirring was continued for 1 hour while maintaining 150° C., followed by removal of the monomer for the styrenic resin component for 1 hour at 8.3 kPa. The temperature was then raised to 190° C. and a reaction was run until the desired molecular weight was reached, thereby obtaining the crystalline resin 21.

<Production of Crystalline Resin 22>

Crystalline resin 22 was obtained proceeding in accordance with the production method for crystalline resin 21, with the exception that the number of parts of addition for the acrylic acid was changed from 15.0 parts to 3.0 parts and the number of parts of addition for the styrene was changed from 80.0 parts to 20.0 parts.

<Production of Crystalline Resin 23>

100.0 parts of behenyl acrylate, 64.0 parts of methyl ethyl ketone, 0.4 parts of copper(I) bromide, 0.5 parts of pentamethyldiethylenetriamine, and 1.0 parts of ethyl 2-bromoisobutyrate were introduced into a flask and nitrogen substitution was carried out for 1 hour at normal temperature and normal pressure. The temperature was then raised to 65° C. and a reaction was run until the desired molecular weight was reached to yield a polybehenyl acrylate.

Then, after cooling to room temperature, 100.0 parts of this polybehenyl acrylate was dissolved in 200.0 parts of chloroform and reprecipitation was performed with 800.0 parts of ethanol followed by filtration and purification. The polybehenyl acrylate had a weight-average molecular weight (Mw), as measured in accordance with the previously described method, of 11,000 and a melting point (Tm) of 65° C.

100.0 parts of the purified polybehenyl acrylate, 100.0 parts of styrene, 1.1 parts of copper(I) bromide, and 1.3 parts of pentamethyldiethylenetriamine were then added to a flask and nitrogen substitution was performed for 1 hour at normal temperature and normal pressure. After this, the temperature was raised to 100° C., and the reaction was stopped once the desired molecular weight had been reached to yield a polybehenyl acrylate-polystyrene block copolymer. After cooling to room temperature, 100.0 parts of this polybehenyl acrylate-polystyrene block copolymer was dissolved in 200.0 parts of chloroform, and reprecipitation with 800.0 parts of methanol was performed followed by filtration, purification, and removal of the solvent, catalyst, and unreacted monomer. Drying was subsequently carried out in a vacuum dryer set to 50° C. to obtain crystalline resin 23.

<Production of Crystalline Resin 24>

A crystalline polyester was obtained by introducing 100.0 parts of sebacic acid, 80.0 parts of 1,9-nonanediol, and 0.1 parts of dibutyltin oxide into a nitrogen-substituted flask, and by carrying out a reaction for 4 hours at 170° C. and additionally at 210° C. under reduced pressure until the desired molecular weight was reached. This crystalline polyester had a weight-average molecular weight (Mw), as measured in accordance with the previously described method, of 19,000 and a melting point (Tm) of 65° C.

An amorphous polyester was obtained by introducing 40.0 parts of terephthalic acid, 22.0 parts of isophthalic acid, 40.0 parts of the 2 mol adduct of propylene oxide on bisphenol A, 20.0 parts of ethylene glycol, and 0.1 parts of dibutyltin oxide into a nitrogen-substituted flask, and by carrying out a reaction for 4 hours at 150° C. and additionally at 200° C. under reduced pressure until the desired molecular weight was reached. This amorphous polyester had a weight-average molecular weight (Mw), as measured in accordance with the previously described method, of 8,000 and a glass transition temperature (Tg) of 63° C.

200 parts of this crystalline polyester and 200 parts of the aforementioned amorphous polyester were reacted in a flask under a nitrogen current at 200° C. under reduced pressure until the desired molecular weight was reached, thereby yielding crystalline resin 24.

The properties of the obtained crystalline resins 1 to 27 are shown in Table 2.

<Production of Toner 1>

A mixture was prepared by introducing the following materials into a beaker and mixing while stirring at a stirring rate of 100 rpm using a propeller-type stirring device.

| | |
|---|---|
| styrene | 52.5 parts |
| n-butyl acrylate | 17.5 parts |
| Pigment Blue 15:3 | 6.0 parts |
| aluminum salicylate compound (BONTRON E-88, from Orient Chemical Industries Co., Ltd.) | 1.0 parts |
| polar resin (styrene-2-hydroxyethyl methacrylate-methacrylic acid-methyl methacrylate copolymer, acid value = 10 mg KOH/g, Tg = 80° C., Mw = 15,000) | 5.0 parts |
| release agent (paraffin wax) (HNP-9, from Nippon Seiro Co., Ltd., melting point = 75° C.) | 7.0 parts |
| crystalline resin 1 | 30.0 parts |

The mixture was subsequently heated to 65° C. to obtain a polymerizable monomer composition.

800 parts deionized water and 15.5 parts tricalcium phosphate were then added to a vessel equipped with a TK Homomixer (Tokushu Kika Kogyo Co., Ltd.) high-speed mixer, and an aqueous medium was produced by heating to 70° C. at a rotation rate brought to 15,000 rpm.

While maintaining the temperature of the aqueous medium at 70° C. and the rotation rate of the stirrer at 15,000 rpm, the polymerizable monomer composition was introduced into the aqueous medium and 4.0 parts of the polymerization initiator t-butyl peroxypivalate was added. A granulating step was carried out for 20 minutes while maintaining the stirrer unchanged at 15,000 rpm. The high-speed stirrer was then replaced with a stirrer equipped with propeller stirring blades;

TABLE 2

| | crystalline segment | | amorphous segment | | overall crystalline resin | | | | |
|---|---|---|---|---|---|---|---|---|---|
| | Mw | SP value | Mw | SP value | Mw | Tm (° C.) | loss elastic modulus at 100° C. (Pa) | crystalline segment:amorphous segment mass ratio | polymer type |
| crystalline resin 1 | 19000 | 9.62 | 7500 | 9.83 | 33000 | 69 | 500 | 50:50 | block polymer |
| crystalline resin 2 | 19000 | 9.62 | 9000 | 9.83 | 35000 | 67 | 2000 | 40:60 | block polymer |
| crystalline resin 3 | 19000 | 9.62 | 6000 | 9.83 | 29000 | 69 | 200 | 70:30 | block polymer |
| crystalline resin 4 | 19000 | 9.62 | 5100 | 9.83 | 29000 | 72 | 50 | 90:10 | block polymer |
| crystalline resin 5 | 22000 | 9.35 | 8000 | 9.83 | 35000 | 91 | 1500 | 50:50 | block polymer |
| crystalline resin 6 | 19000 | 10.06 | 7000 | 9.83 | 30000 | 58 | 300 | 60:40 | block polymer |
| crystalline resin 7 | 15000 | 9.48 | 5500 | 9.83 | 27000 | 83 | 300 | 50:50 | block polymer |
| crystalline resin 8 | 22000 | 9.80 | 8000 | 9.83 | 36000 | 67 | 800 | 60:40 | block polymer |
| crystalline resin 9 | 10000 | 10.18 | 5200 | 9.83 | 20000 | 81 | 200 | 50:50 | block polymer |
| crystalline resin 10 | 19000 | 9.62 | 9000 | 9.68 | 32000 | 64 | 180 | 50:50 | block polymer |
| crystalline resin 11 | 19000 | 9.62 | 6000 | 9.48 | 28000 | 62 | 80 | 50:50 | block polymer |
| crystalline resin 12 | 19000 | 9.62 | 12000 | 9.83 | 45000 | 63 | 2800 | 30:70 | block polymer |
| crystalline resin 13 | 19000 | 9.62 | 14000 | 9.83 | 50000 | 59 | 4000 | 25:75 | block polymer |
| crystalline resin 14 | 12000 | 10.06 | 6000 | 9.83 | 26000 | 57 | 200 | 50:50 | block polymer |
| crystalline resin 15 | 14000 | 9.35 | 4000 | 9.83 | 22000 | 93 | 100 | 70:30 | block polymer |
| crystalline resin 16 | 7000 | 9.48 | 2000 | 9.48 | 12000 | 81 | 30 | 70:30 | block polymer |
| crystalline resin 17 | 19000 | 10.18 | 5000 | 9.83 | 29000 | 83 | 200 | 70:30 | block polymer |
| crystalline resin 18 | 22000 | 9.80 | — | — | 22000 | 70 | 30 | 100:0 | homopolymer |
| crystalline resin 19 | 19000 | 9.62 | — | — | 19000 | 75 | 30 | 100:0 | homopolymer |
| crystalline resin 20 | 19000 | 9.48 | — | — | 19000 | 83 | 30 | 100:0 | homopolymer |
| crystalline resin 21 | 15000 | 9.62 | 8000 | 9.83 | 22000 | 65 | 80 | 70:30 | graft polymer |
| crystalline resin 22 | 14000 | 9.62 | 8000 | 9.83 | 25000 | 77 | 50 | 95:5 | graft polymer |
| crystalline resin 23 | 11000 | 8.92 | 5000 | 9.83 | 20000 | 65 | 70 | 50:50 | block polymer |
| crystalline resin 24 | 19000 | 9.62 | 8000 | 10.05 | 35000 | 62 | 1000 | 50:50 | block polymer |
| crystalline resin 25 | 19000 | 9.62 | 5800 | 9.83 | 28000 | 70 | 150 | 80:20 | block polymer |
| crystalline resin 26 | 10000 | 9.62 | 4200 | 9.83 | 15000 | 69 | 150 | 70:30 | block polymer |
| crystalline resin 27 | 10000 | 9.62 | 3200 | 9.83 | 14000 | 69 | 100 | 70:30 | block polymer |

a polymerization was run for 6.0 hours while holding at 80° C. and stirring at 150 rpm; and the solvent and unreacted monomer were removed by raising the temperature to 100° C. and heating for 4 hours.

After the completion of the polymerization reaction, the slurry was cooled, the pH was brought to 1.4 by the addition of hydrochloric acid to the cooled slurry, and the calcium phosphate salt was dissolved by stirring for 1 hour. Washing with water at 10-fold relative to the slurry was performed followed by filtration and drying and subsequent adjustment of the particle diameter by classification to obtain toner particles. A toner 1 was obtained by mixing 100.0 parts of these toner particles for 15 minutes using a Henschel mixer (Mitsui Miike Chemical Engineering Machinery Co., Ltd.) at a stirring rate of 3,000 rpm with 1.5 parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles.

<Production of Toners 2 to 26 and 29 to 41>

Toners 2 to 26 and 29 to 41 were obtained proceeding as in the method of producing toner 1, with the exception that the materials and amounts of incorporation were changed as shown in Table 3.

<Production of Toner 27>

The following materials were introduced under a nitrogen atmosphere into a reactor fitted with a reflux condenser, stirrer, and nitrogen introduction tube.

| | |
|---|---|
| xylene | 100.0 parts |
| styrene | 80.0 parts |
| n-butyl acrylate | 20.0 parts |
| t-butyl peroxypivalate | 3.0 parts |

The materials were mixed by stirring at 200 rpm and were heated to 70° C. and stirred for 10 hours. Heating to 100° C. was then carried out and the solvent was distilled out for 6 hours to obtain a styrene-acrylic resin. The following components were then mixed and dispersed for 10 hours in a ball mill:

| | |
|---|---|
| the styrene-acrylic resin | 70.0 parts |
| crystalline resin 1 | 30.0 parts |
| paraffin wax release agent (HNP-9: Nippon Seiro Co., Ltd., melting point = 75° C.) | 7.0 parts |
| Pigment Blue 15:3 | 6.0 parts |
| aluminum salicylate compound (BONTRON E-88, from Orient Chemical Industries Co., Ltd.) | 1.0 parts |
| ethyl acetate | 200.0 parts; |

the resulting dispersion was introduced into 2000 parts deionized water that contained 3.5 mass % tricalcium phosphate; and granulation was performed for 10 minutes at a rotation rate of 15,000 rpm using a TK Homomixer high-speed stirrer. This was followed by solvent removal by holding for 4 hours at 75° C. on a water bath while stirring at 150 rpm using a three-one motor. The resulting slurry was cooled, the pH was brought to 1.4 by the addition of hydrochloric acid to the cooled slurry, and the calcium phosphate salt was dissolved by stirring for 1 hour. Washing with water at 10-fold relative to the slurry was performed followed by filtration and drying and subsequent adjustment of the particle diameter by classification to obtain toner particles. A toner 27 was obtained by mixing 100.0 parts of these toner particles for 15 minutes using a Henschel mixer (Mitsui Miike Chemical Engineering Machinery Co., Ltd.) at a stirring rate of 3,000 rpm with 1.5 parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles.

<Production of Toner 28>

(Production of a Resin Dispersion)

| | |
|---|---|
| styrene | 78.0 parts |
| n-butyl acrylate | 22.0 parts |

The preceding were mixed with dissolution; this was dispersed and emulsified in 120.0 parts deionized water in which 1.5 parts of a nonionic surfactant (Sanyo Chemical Industries, Ltd.: Nonipol 400) and 2.2 parts of an anionic surfactant (Dai-ichi Kogyo Seiyaku Co., Ltd.: Neogen SC) were dissolved; and 1.5 parts of the polymerization initiator ammonium persulfate dissolved in 10.0 parts deionized water was gradually introduced over 10 minutes while mixing. After nitrogen substitution, the contents were heated to a temperature of 70° C. while stirring and an emulsion polymerization was continued under these conditions for 4 hours. This was followed by adjustment of the amount of deionized water so as to bring the solids concentration to 20.0 mass %, thereby producing a resin dispersion in which a resin having an average particle diameter of 0.29 μm was dispersed.

(Production of a Crystalline Resin Dispersion)

| | |
|---|---|
| crystalline resin 1 | 50.0 parts |
| anionic surfactant (Dai-ichi Kogyo Seiyaku Co., Ltd.: Neogen SC) | 7.0 parts |
| deionized water | 200.0 parts |

The preceding were heated to 95° C.; dispersion was carried out using a homogenizer (IKA: Ultra-Turrax T50); and a dispersion treatment was then performed using a pressure-ejection homogenizer. This was followed by adjustment of the amount of deionized water so as to bring the solids concentration to 20.0 mass %, thereby producing a crystalline resin dispersion in which crystalline resin 1 was dispersed.

(Production of a Colorant-Dispersed Solution)

| | |
|---|---|
| cyan colorant (C.I. Pigment Blue 15:3) | 20.0 parts |
| anionic surfactant (Dia-ichi Kogyo Seiyaku Co., Ltd.: Neogen SC) | 3.0 parts |
| deionized water | 78.0 parts |

The preceding were mixed and were dispersed using a sand grinder mill. This was followed by adjustment of the amount of deionized water so as to bring the solids concentration to 20.0 mass %. When the particle size distribution in this colorant-dispersed solution was measured using a particle distribution analyzer (LA-700 from Horiba, Ltd.), the average particle diameter of the colorant contained therein was 0.20 μm and coarse particles in excess of 1.00 μm were not observed.

(Production of a Release Agent Dispersion)

| | |
|---|---|
| hydrocarbon wax (HNP-9: Nippon Seiro Co., Ltd., melting point= 75° C.) | 50.0 parts |
| anionic surfactant (Dai-ichi Kogyo Seiyaku Co., Ltd.: Neogen SC) | 7.0 parts |
| deionized water | 200.0 parts |

The preceding were heated to 95° C.; dispersion was carried out using a homogenizer (IKA: Ultra-Turrax T50); and a dispersion treatment was then performed using a pressure-ejection homogenizer. This was followed by adjustment of the amount of deionized water so as to bring the solids concentration to 20.0 mass %, thereby producing a wax particle dispersion in which wax with an average particle size of 0.50 μm was dispersed.

(Production of a Charge Control Particle Dispersion)

| | |
|---|---|
| metal compound of a dialkylsalicylic acid (negative-chargeability control agent, BONTRON E-84, from Orient Chemical Industries Co., Ltd.) | 5.0 parts |
| anionic surfactant (Dai-ichi Kogyo Seiyaku Co., Ltd.: Neogen SC) | 3.0 parts |
| deionized water | 78.0 parts |

The preceding were mixed and were dispersed using a sand grinder mill. This was followed by adjustment of the amount of deionized water so as to bring the solids concentration to 5.0 mass %.

(Mixture Production)

| | |
|---|---|
| resin dispersion | 70.0 parts |
| crystalline resin dispersion | 30.0 parts |
| colorant-dispersed solutin | 6.0 parts |
| release agent dispersion | 7.0 parts |

The preceding were introduced into a 1-liter separable flask fitted with a stirrer, condenser, and thermometer and were stirred. The resulting mixture was brought to pH=5.2 using 1 mol/L potassium hydroxide. 120.0 parts of an 8.0 mass % aqueous sodium chloride solution was added dropwise as a flocculating agent to this mixture, and heating was carried out to a temperature of 55° C. while stirring. Upon reaching this temperature, 2.0 parts of the charge control particle dispersion was added. After holding for 2 hours at a temperature of 55° C., observation with an optical microscope showed that aggregate particles with an average particle diameter of 3.3 μm had been formed.

A supplementary addition of 3.0 parts of an anionic surfactant (Dai-ichi Kogyo Seiyaku Co., Ltd.: Neogen SC) was subsequently made, followed by heating to a temperature of 95° C. while continuing to stir and then holding for 4.5 hours. This slurry was cooled and was washed with water at 10-fold relative to the slurry followed by filtration and drying and subsequent adjustment of the particle diameter by classification to obtain toner particles.

A toner 28 was obtained by mixing 100.0 parts of these toner particles for 15 minutes using a Henschel mixer (Mitsui Miike Chemical Engineering Machinery Co., Ltd.) at a stirring rate of 3,000 rpm with 1.5 parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles.

The properties of the obtained toners 1 to 41 are given in Table 3.

TABLE 3

| | crystalline resin | | styrene-acrylic resin | | | | | | |
|---|---|---|---|---|---|---|---|---|---|
| | No. | amount of addition (parts) | composition | mass ratio of the polymerizable monomers | amount of addition (parts) | SP value | release agent | Mw | Tg |
| toner 1 | 1 | 30.0 | styrene:n-BA | 75:25 | 70.0 | 9.80 | HNP-9 | 27000 | 52.0 |
| toner 2 | 2 | 40.0 | styrene:n-BA | 75:25 | 60.0 | 9.80 | HNP-9 | 27000 | 51.1 |
| toner 3 | 3 | 25.0 | styrene:n-BA | 75:25 | 75.0 | 9.80 | HNP-9 | 27000 | 52.2 |
| toner 4 | 21 | 25.0 | styrene:n-BA | 75:25 | 75.0 | 9.80 | HNP-9 | 27000 | 48.9 |
| toner 5 | 4 | 15.0 | styrene:n-BA | 75:25 | 85.0 | 9.80 | HNP-9 | 27000 | 51.3 |
| toner 6 | 5 | 30.0 | styrene:n-BA | 75:25 | 70.0 | 9.80 | HNP-9 | 27000 | 52.1 |
| toner 7 | 6 | 30.0 | styrene:n-BA | 75:25 | 70.0 | 9.80 | HNP-9 | 27000 | 47.3 |
| toner 8 | 5 | 30.0 | styrene:PA | 74:26 | 70.0 | 9.85 | HNP-9 | 25000 | 51.2 |
| toner 9 | 5 | 30.0 | styrene:t-BA | 28:72 | 70.0 | 9.48 | HNP-9 | 24000 | 55.0 |
| toner 10 | 7 | 30.0 | styrene:n-BA | 75:25 | 70.0 | 9.80 | HNP-9 | 27000 | 50.1 |
| toner 11 | 7 | 30.0 | styrene:PA | 74:26 | 70.0 | 9.85 | HNP-9 | 25000 | 51.1 |
| toner 12 | 7 | 30.0 | styrene:t-BA | 28:72 | 70.0 | 9.48 | HNP-9 | 24000 | 48.7 |
| toner 13 | 1 | 30.0 | styrene:PA | 74:26 | 70.0 | 9.85 | HNP-9 | 25000 | 49.2 |
| toner 14 | 1 | 30.0 | styrene:t-BA | 28:72 | 70.0 | 9.48 | HNP-9 | 24000 | 53.4 |
| toner 15 | 8 | 30.0 | styrene:n-BA | 75:25 | 70.0 | 9.80 | HNP-9 | 27000 | 48.2 |
| toner 16 | 8 | 30.0 | styrene:PA | 74:26 | 70.0 | 9.85 | HNP-9 | 25000 | 49.9 |
| toner 17 | 8 | 30.0 | styrene:t-BA | 28:72 | 70.0 | 9.48 | HNP-9 | 24000 | 52.3 |
| toner 18 | 9 | 30.0 | styrene:n-BA | 75:25 | 70.0 | 9.80 | HNP-9 | 27000 | 50.1 |
| toner 19 | 9 | 30.0 | styrene:PA | 74:26 | 70.0 | 9.85 | HNP-9 | 25000 | 48.0 |
| toner 20 | 23 | 30.0 | styrene:n-BA | 75:25 | 70.0 | 9.80 | HNP-9 | 27000 | 54.0 |
| toner 21 | 24 | 30.0 | styrene:n-BA | 75:25 | 70.0 | 9.80 | HNP-9 | 27000 | 49.9 |
| toner 22 | 10 | 30.0 | styrene:t-BA | 28:72 | 70.0 | 9.48 | HNP-9 | 24000 | 47.9 |
| toner 23 | 11 | 30.0 | styrene:t-BA | 28:72 | 70.0 | 9.48 | HNP-9 | 24000 | 47.3 |
| toner 24 | 1 | 6.0 | styrene:n-BA | 75:25 | 94.0 | 9.80 | HNP-9 | 26000 | 53.8 |
| toner 25 | 1 | 50.0 | styrene:n-BA | 75:25 | 50.0 | 9.80 | HNP-9 | 27000 | 47.9 |
| toner 26 | 1 | 55.0 | styrene:n-BA | 75:25 | 45.0 | 9.80 | HNP-9 | 28000 | 46.9 |
| toner 27 | 1 | 30.0 | styrene:n-BA | 80:20 | 70.0 | 9.80 | HNP-9 | 40000 | 55.1 |
| toner 28 | 1 | 30.0 | styrene:n-BA | 78:22 | 70.0 | 9.80 | HNP-9 | 19000 | 46.9 |
| toner 29 | 12 | 30.0 | styrene:n-BA | 75:25 | 70.0 | 9.80 | HNP-9 | 27000 | 47.1 |
| toner 30 | 13 | 30.0 | styrene:n-BA | 75:25 | 70.0 | 9.80 | HNP-9 | 27000 | 50.0 |
| toner 31 | 22 | 30.0 | styrene:n-BA | 75:25 | 70.0 | 9.80 | HNP-9 | 27000 | 48.8 |
| toner 32 | 18 | 30.0 | styrene:n-BA | 75:25 | 70.0 | 9.80 | HNP-9 | 27000 | 46.2 |
| toner 33 | 19 | 30.0 | styrene:n-BA | 75:25 | 70.0 | 9.80 | HNP-9 | 27000 | 47.5 |

TABLE 3-continued

| | crystalline resin | | styrene-acrylic resin | | | | | | |
|---|---|---|---|---|---|---|---|---|---|
| | No. | amount of addition (parts) | composition | mass ratio of the polymerizable monomers | amount of addition (parts) | SP value | release agent | Mw | Tg |
| toner 34 | 20 | 30.0 | styrene:n-BA | 75:25 | 70.0 | 9.80 | HNP-9 | 27000 | 50.0 |
| toner 35 | 14 | 30.0 | styrene:n-BA | 75:25 | 70.0 | 9.80 | HNP-9 | 27000 | — |
| toner 36 | 15 | 30.0 | styrene:PA | 74:26 | 70.0 | 9.85 | HNP-9 | 25000 | 51.0 |
| toner 37 | 16 | 30.0 | styrene:PA | 70:30 | 70.0 | 9.90 | HNP-9 | 25000 | 51.2 |
| toner 38 | 17 | 30.0 | styrene:t-BA | 28:72 | 70.0 | 9.48 | HNP-9 | 24000 | 56.8 |
| toner 39 | 25 | 20.0 | styrene:n-BA | 75:25 | 80.0 | 9.80 | HNP-9 | 27000 | 52.0 |
| toner 40 | 26 | 25.0 | styrene:n-BA | 75:25 | 75.0 | 9.80 | HNP-9 | 27000 | 49.0 |
| toner 41 | 27 | 25.0 | styrene:n-BA | 75:25 | 75.0 | 9.80 | HNP-9 | 27000 | 47.0 |

In Table 3, t-BA refers to t-butyl acrylate, n-BA refers to n-butyl acrylate, and PA refers to propyl acrylate.

<MDSC Measurement on the Binder Resins>

MDSC measurements were performed on the binder resins in toners 1 to 41 in accordance with method described above. The results are given in Table 4.

TABLE 4

| | results of the MDSC measurements on the binder resins in the individual toners | | | |
|---|---|---|---|---|
| toner | Tm (° C.) | total heat flow (J/g) | reversing heat flow (J/g) | reversing heat flow percentage (%) |
| toner 1 | 65 | 12.0 | 0.1 | 0.8 |
| toner 2 | 63 | 9.8 | 0.0 | 0.0 |
| toner 3 | 65 | 17.5 | 2.6 | 14.9 |
| toner 4 | 61 | 19.8 | 6.6 | 33.3 |
| toner 5 | 70 | 18.9 | 6.0 | 31.7 |
| toner 6 | 88 | 14.7 | 3.6 | 24.5 |
| toner 7 | 55 | 11.6 | 0.1 | 0.9 |
| toner 8 | 90 | 16.2 | 5.6 | 34.6 |
| toner 9 | 87 | 15.6 | 3.1 | 20.0 |
| toner 10 | 80 | 19.0 | 3.4 | 19.9 |
| toner 11 | 81 | 20.5 | 6.0 | 29.3 |
| toner 12 | 77 | 17.4 | 2.1 | 12.1 |
| toner 13 | 65 | 11.2 | 0.5 | 4.5 |
| toner 14 | 64 | 9.9 | 0.0 | 0.0 |
| toner 15 | 63 | 12.4 | 0.0 | 0.0 |
| toner 16 | 60 | 9.2 | 0.1 | 1.1 |
| toner 17 | 64 | 12.3 | 1.4 | 11.4 |
| toner 18 | 75 | 10.1 | 1.8 | 17.8 |
| toner 19 | 75 | 8.9 | 0.1 | 1.1 |
| toner 20 | 62 | 28.1 | 9.8 | 34.9 |
| toner 21 | 59 | 7.9 | 2.6 | 32.9 |
| toner 22 | 58 | 9.9 | 0.0 | 0.0 |
| toner 23 | 58 | 7.9 | 0.0 | 0.0 |
| toner 24 | 65 | 2.1 | 0.0 | 0.0 |
| toner 25 | 65 | 17.0 | 0.1 | 0.6 |
| toner 26 | 65 | 18.2 | 0.8 | 4.4 |
| toner 27 | 65 | 14.2 | 1.6 | 11.3 |
| toner 28 | 65 | 6.9 | 0.0 | 0.0 |
| toner 29 | 59 | 6.9 | 0.0 | 0.0 |
| toner 30 | 55 | 2.2 | 0.0 | 0.0 |
| toner 31 | 75 | 20.0 | 6.9 | 34.5 |
| toner 32 | 62 | 20.2 | 7.4 | 36.6 |
| toner 33 | 73 | 23.2 | 13.5 | 58.2 |
| toner 34 | 83 | 24.4 | 21.9 | 89.8 |
| toner 35 | 52 | 5.9 | 0.0 | 0.0 |
| toner 36 | 91 | 20.2 | 6.9 | 34.2 |
| toner 37 | 79 | 18.7 | 7.5 | 40.1 |
| toner 38 | 75 | 12.7 | 8.0 | 63.0 |
| toner 39 | 65 | 18.2 | 4.7 | 25.0 |
| toner 40 | 65 | 15.0 | 2.3 | 15.0 |
| toner 41 | 65 | 12.0 | 1.9 | 15.0 |

The properties of each toner were evaluated in accordance with the following methods.

[The Heat-Resistant Storability (Heat Resistance)]

5 g of the particular toner was placed in a 50-cc plastic cup and was held for 3 days at a temperature of 50° C./humidity of 10% RH, and the evaluation was then performed by checking for the presence/absence of aggregate lumps.

(Evaluation Criteria)

A: no aggregate lumps are produced (particularly excellent heat resistance)

B: minor aggregate lumps are produced and are broken up by light shaking (excellent heat resistance)

C: minor aggregate lumps are produced and are broken up by light finger pressure (no problem for the heat resistance)

D: aggregate lumps are produced, but are not collapsed even by light finger pressure (somewhat poor heat resistance, problematic from a use standpoint)

E: complete aggregation (poor heat resistance, problematic from a use standpoint)

[Developing Performance]

The evaluation was carried out using a commercial color laser printer (HP Color LaserJet 3525dn, from Hewlett-Packard) that had been modified to operate with just a single color process cartridge installed. The toner in the cyan cartridge installed in this color laser printer was extracted; the interior was cleaned with an air blower; and the toner (300 g) to be evaluated was filled as a replacement. 500 prints of a chart with a 2% print percentage were continuously output at normal temperature and normal humidity (23° C., 60% RH) using Office Planner (64 g/cm$^2$) from Canon, Inc. as the image-receiving paper. After this output run, a halftone image was additionally output and the development performance was evaluated as indicated below by checking the presence/absence of image streaks in this halftone image and checking the presence/absence of melt-adhered material on the developing roller.

(Evaluation Criteria)

A: Vertical streaks in the discharge direction considered to be development stripes are not seen on the developing roller or on the image in the halftone region. (particularly excellent developing performance)

B: From 1 to 4 thin streaks are present circumferentially at the two ends of the developing roller, but vertical streaks in the discharge direction considered to be development stripes are not seen on the image in the halftone region. (excellent developing performance)

C: From 1 to 4 thin streaks are present circumferentially at the two ends of the developing roller, and several thin development stripes are also seen on the image in the halftone region. (not problematic for the developing performance)

D: At least 5 thin streaks are present circumferentially at the two ends of the developing roller, and at least 5 thin development stripes are also seen on the image in the halftone region. (somewhat poor developing performance, problematic from a use standpoint)

E: A large number of significant development stripes are seen on the developing roller and the image in the halftone region. (poor developing performance, problematic from a use standpoint)

[Fixing Performance]

A color laser printer (HP Color LaserJet 3525dn, Hewlett-Packard) from which the fixing unit had been removed was prepared; the toner was removed from the cyan cartridge; and the toner to be evaluated was filled as a replacement. Then, using the filled toner, a 2.0 cm long by 15.0 cm wide unfixed toner image (0.6 mg/cm$^2$) was formed on the image-receiving paper (Office Planner from Canon, Inc., 64 g/m$^2$) at a position 1.0 cm from the top edge considered in the paper transit direction. The removed fixing unit was modified so the fixation temperature and process speed could be adjusted and was used to conduct a fixing test on the unfixed image.

First, operating in a normal temperature and normal humidity environment (23° C., 60% RH) at a process speed of 250 mm/s and with the fixing linear pressure set to 27.4 kgf and the initial temperature set to 100° C., the unfixed image was fixed at each temperature level while raising the set temperature sequentially in 5° C. increments. In the case of the release agent-free toner produced for the MDSC measurements, an appropriate amount of a silicone oil (viscosity=200 cps) was coated on the fixing roller prior to the evaluation.

The evaluation criteria for the low-temperature fixability are given below. The low-temperature-side fixing starting point is defined as follows: a fold in the vertical direction is made in the central region of the image and a crease is made using a load of 4.9 kPa (50 g/cm$^2$); a crease is similarly made in the direction orthogonal to the first crease; the intersection of the creases is rubbed 5 times at a speed of 0.2 m/second with lens cleaning paper (Dusper K-3) loaded with 4.9 kPa (50 g/cm$^2$); and the low-temperature-side fixing starting point is taken to be the lowest temperature at which the percentage decline in the density pre-versus-post-rubbing is 10% or less.

(Evaluation Criteria)

A: the low-temperature-side fixing starting point is equal to or less than 115° C. (the low-temperature fixability is particularly excellent)

B: the low-temperature-side fixing starting point is 120° C. or 125° C. (excellent low-temperature fixability)

C: the low-temperature-side fixing starting point is 130° C. or 135° C. (unproblematic low-temperature fixability)

D: the low-temperature-side fixing starting point is 140° C. or 145° C. (somewhat poor low-temperature fixability, problematic from a use standpoint)

E: the low-temperature-side fixing starting point is 150° C. or more (poor low-temperature fixability, problematic from a use standpoint)

The hot offset resistance was also evaluated with the preceding fixing test, using the following evaluation criteria.

(Evaluation Criteria)

A: the highest temperature at which hot offset is not produced, is equal to or greater than 50° C.+the temperature of the low-temperature-side fixing starting point (the hot offset resistance is particularly excellent)

B: the highest temperature at which hot offset is not produced is equal to or greater than 40° C.+the temperature of the low-temperature-side fixing starting point, but is less than 50° C.+the temperature of the low-temperature-side fixing starting point (the hot offset resistance is excellent)

C: the highest temperature at which hot offset is not produced is equal to or greater than 30° C.+the temperature of the low-temperature-side fixing starting point, but is less than 40° C.+the temperature of the low-temperature-side fixing starting point (this is a level at which the hot offset resistance is not problematic)

D: the highest temperature at which hot offset is not produced is equal to or greater than 20° C.+the temperature of the low-temperature-side fixing starting point, but is less than 30° C.+the temperature of the low-temperature-side fixing starting point (the hot offset resistance is somewhat poor)

E: hot offset is produced in the temperature range that is less than 20° C.+the temperature of the low-temperature-side fixing starting point (the hot offset resistance is poor)

For an image fixed at a set temperature 10° C. higher than the low-temperature-side fixing starting point, the gloss value of the image was measured at an angle of light incidence of 75° using a Gloss Meter PG-3D Handy Gloss Meter (Nippon Denshoku Industries Co., Ltd.), and was evaluated used the following criteria.

(Evaluation Criteria)

A: the gloss value in the image area is at least 20 (the image gloss value is particularly excellent)

B: the gloss value in the image area is at least 15 but less than 20 (the image gloss value is excellent)

C: the gloss value in the image area is at least 10 but less than 15 (this is a level at which the image gloss value is unproblematic)

D: the gloss value in the image area is at least 5 but less than 10 (the image gloss value is somewhat poor)

E: the gloss value in the image area is less than 5 (the image gloss value is poor)

Examples 1 to 32

The evaluations described above were carried out in Examples 1 to 32 using each of the toners 1 to 29 and 39 to 41 as the toner. The results of these evaluations are given in Table 5.

Comparative Examples 1 to 9

The evaluations described above were carried out in Comparative Examples 1 to 9 using each of the toners to 38 as the toner. The results of these evaluations are given in Table 5.

TABLE 5

| | | | developing performance | | fixing performance | | | | | |
|---|---|---|---|---|---|---|---|---|---|---|
| | | | | | low-temperature | | hot offset resistance | | | |
| | toner (No.) | heat resistance rank | rank | number of streaks on the developing roller (number) | rank | low-temperature-side fixing starting point (° C.) | rank | highest temperature at which hot offset is not produced (° C.) | gloss value rank | gloss value |
| example1 | 1 | A | A | 0 | A | 110 | A | 160 | A | 23 |
| example2 | 2 | A | A | 0 | A | 110 | A | 180 | A | 20 |
| example3 | 3 | A | A | 0 | A | 110 | A | 160 | A | 25 |
| example4 | 4 | B | B | 3 | B | 125 | C | 155 | B | 18 |
| example5 | 5 | A | A | 0 | C | 130 | C | 160 | B | 16 |
| example6 | 6 | A | A | 0 | C | 130 | B | 170 | B | 19 |
| example7 | 7 | C | B | 1 | A | 110 | A | 160 | A | 25 |
| example8 | 8 | A | B | 1 | C | 130 | A | 180 | B | 19 |
| example9 | 9 | A | B | 1 | B | 125 | A | 180 | C | 11 |
| example10 | 10 | A | A | 0 | A | 115 | A | 170 | A | 22 |
| example11 | 11 | A | A | 0 | C | 130 | B | 170 | A | 20 |
| example12 | 12 | B | A | 0 | B | 125 | B | 170 | C | 11 |
| example13 | 13 | A | A | 0 | A | 110 | A | 165 | A | 27 |
| example14 | 14 | A | A | 0 | A | 115 | A | 165 | C | 11 |
| example15 | 15 | B | A | 0 | A | 110 | A | 160 | A | 28 |
| example16 | 16 | A | A | 0 | A | 110 | A | 170 | A | 28 |
| example17 | 17 | A | A | 0 | A | 115 | A | 165 | C | 11 |
| example18 | 18 | B | A | 0 | C | 130 | A | 180 | B | 19 |
| example19 | 19 | B | B | 3 | B | 120 | A | 180 | B | 19 |
| example20 | 20 | A | C | 2 | C | 135 | C | 165 | B | 15 |
| example21 | 21 | C | C | 4 | C | 130 | A | 180 | C | 14 |
| example22 | 22 | C | B | 1 | A | 115 | B | 155 | B | 18 |
| example23 | 23 | C | C | 3 | A | 110 | A | 160 | A | 27 |
| example24 | 24 | A | A | 0 | C | 135 | A | 190 | C | 11 |
| example25 | 25 | B | B | 2 | A | 105 | C | 140 | A | 25 |
| example26 | 26 | C | C | 4 | A | 105 | C | 135 | A | 25 |
| example27 | 27 | A | A | 0 | B | 120 | A | 170 | C | 14 |
| example28 | 28 | C | C | 4 | A | 115 | A | 170 | A | 21 |
| example29 | 29 | C | B | 1 | C | 135 | A | 200 | C | 13 |
| comparative example1 | 30 | A | B | 1 | E | 150 | A | 200 | D | 9 |
| comparative example2 | 31 | C | B | 3 | D | 140 | D | 160 | B | 19 |
| comparative example3 | 32 | E | D | 8 | B | 125 | D | 145 | B | 18 |
| comparative example4 | 33 | D | C | 4 | C | 130 | E | 145 | C | 14 |
| comparative example5 | 34 | B | A | 0 | E | 150 | E | 160 | D | 8 |
| comparative example6 | 35 | E | D | 10 | A | 110 | B | 150 | A | 21 |
| comparative example7 | 36 | A | A | 0 | D | 140 | B | 180 | C | 10 |
| comparative example8 | 37 | A | A | 0 | D | 140 | D | 165 | D | 6 |
| comparative example9 | 38 | A | A | 0 | D | 140 | D | 165 | D | 9 |
| example30 | 39 | A | A | 0 | B | 125 | A | 160 | A | 25 |
| example31 | 40 | B | A | 0 | A | 110 | B | 150 | A | 25 |
| example32 | 41 | C | A | 0 | A | 110 | C | 140 | A | 25 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247687, filed Nov. 29, 2013, and which is hereby incorporated by reference herein in its entirety.

What is claimed is:

1. A toner comprising:

a toner particle that contains a binder resin, wherein;

the binder resin contains a styrene-acrylic resin and a crystalline resin, the crystalline resin is a block polymer or a graft polymer which has a crystalline segment and an amorphous segment, the mass ratio between the crystalline segment and the amorphous segment is from 30:70 to 90:10, and wherein;

in a total heat flow of the binder resin obtained by measuring the binder resin with a temperature-modulated differential scanning calorimeter, a peak temperature of an endothermic peak is from at least 55.0° C. to not more than 90.0° C., and the percentage of an endothermic quantity of the endothermic peak in a reversing heat flow with respect to an endothermic quantity of the endothermic peak in the total heat flow is from at least 0.0% to not more than 35.0%.

2. The toner according to claim 1, wherein the crystalline resin is a block polymer in which the crystalline segment is a polyester and the amorphous segment is a vinyl polymer.

3. The toner according to claim 1, wherein the mass ratio between the crystalline segment and the amorphous segment in the crystalline resin is from 40:60 to 80:20.

4. The toner according to claim 3, wherein the mass ratio between the crystalline segment and the amorphous segment in the crystalline resin is from 40:60 to 70:30.

5. The toner according to claim 1, wherein the crystalline segment of the crystalline resin has a structure represented by the following formula (1) and a structure represented by the following formula (2):

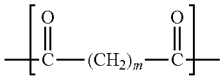

(1)

(in formula (1), m represents an integer from at least 6 to not more than 14)

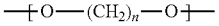

(2)

(in formula (2), n represents an integer from at least 6 to not more than 16).

6. The toner according to claim 1, wherein the absolute value (ΔSP value) of the difference between the solubility parameter (SP) values for the styrene-acrylic resin and the crystalline segment of the crystalline resin is from at least 0.00 to not more than 0.35.

7. The toner according to claim 1, wherein the absolute value (ΔSP value) of the difference between the solubility parameter (SP) values for the styrene-acrylic resin and the amorphous segment of the crystalline resin is from at least 0.00 to not more than 0.35.

8. The toner according to claim 1, wherein the content of the crystalline resin in the binder resin is from at least 2.0 mass % to not more than 50.0 mass %.

9. The toner according to claim 8, wherein the content of the crystalline resin in the binder resin is from at least 6.0 mass % to not more than 50.0 mass %.

10. The toner according to claim 1, wherein the toner particle is a toner particle produced by a suspension polymerization method.

11. The toner according to claim 1, wherein the weight-average molecular weight (Mw) of the crystalline resin is from at least 15,000 to not more than 45,000.

12. The toner according to claim 11, wherein the weight-average molecular weight (Mw) of the crystalline resin is from at least 20,000 to not more than 45,000.

* * * * *